US005652075A

United States Patent [19]

Kanbayashi et al.

[11] Patent Number: 5,652,075

[45] Date of Patent: Jul. 29, 1997

[54] COLOR TONER, TWO-COMPONENT TYPE DEVELOPER, IMAGE FORMING APPARATUS, COLOR IMAGE FORMING METHOD AND PROCESS FOR PRODUCING A COLOR TONER

[75] Inventors: Makoto Kanbayashi, Kawasaki; Hirohide Tanikawa, Yokohama, both of Japan

[73] Assignee: Canon Kabushiki Kaisha, Tokyo, Japan

[21] Appl. No.: 577,815

[22] Filed: Dec. 22, 1995

[30] Foreign Application Priority Data

Dec. 26, 1994 [JP] Japan ..... 6-336618

[51] Int. Cl.[6] ..... G03G 13/01; G03G 9/087; G03G 15/01

[52] U.S. Cl. ..... 430/45; 430/109; 430/111; 430/106; 399/228; 399/284

[58] Field of Search ..... 430/109, 111, 430/45; 118/653; 355/245

[56] References Cited

U.S. PATENT DOCUMENTS

| | | | |
|---|---|---|---|
| 3,681,106 | 8/1972 | Buens et al. . | |
| 3,998,747 | 12/1976 | Yamakami et al. . | |
| 4,271,249 | 6/1981 | Gilliams et al. | 430/101 |
| 4,331,755 | 5/1982 | Gilliams et al. | 430/106 |
| 4,387,211 | 6/1983 | Yasuda et al. | 528/179 |
| 4,533,614 | 8/1985 | Fukumoto et al. | 430/99 |
| 4,657,837 | 4/1987 | Morita et al. | 430/109 |
| 4,917,983 | 4/1990 | Uchida et al. | 430/109 |
| 4,943,506 | 7/1990 | Demizu et al. | 430/109 |
| 5,120,631 | 6/1992 | Kanbayashi et al. | 430/106 |
| 5,330,870 | 7/1994 | Tanaka et al. | 430/109 |
| 5,346,792 | 9/1994 | Kobayashi et al. | 430/109 |
| 5,354,639 | 10/1994 | Kasuya et al. | 430/109 |
| 5,437,949 | 8/1995 | Kanbayashi et al. | 430/45 |

FOREIGN PATENT DOCUMENTS

| | | | |
|---|---|---|---|
| 0369492 | 5/1990 | European Pat. Off. | G03G 63/127 |
| 0523654 | 1/1993 | European Pat. Off. | G03G 9/097 |
| 47-012334 | 6/1972 | Japan . | |
| 50-062442 | 5/1975 | Japan . | |
| 51-144625 | 12/1976 | Japan . | |
| 55-060960 | 5/1980 | Japan . | |
| 57-037353 | 3/1982 | Japan . | |
| 57-109825 | 7/1982 | Japan . | |
| 57-208559 | 1/1983 | Japan . | |
| 58-011953 | 1/1983 | Japan . | |
| 58-014144 | 1/1983 | Japan . | |
| 59-007960 | 1/1984 | Japan . | |
| 59-029256 | 1/1984 | Japan . | |
| 59-057256 | 4/1984 | Japan . | |
| 60-123852 | 7/1985 | Japan . | |
| 61-091666 | 5/1986 | Japan . | |
| 61-117565 | 6/1986 | Japan . | |
| 61-156054 | 7/1986 | Japan . | |
| 62-078568 | 4/1987 | Japan . | |
| 62-195676 | 8/1987 | Japan . | |
| 62-195678 | 8/1987 | Japan . | |
| 62-195680 | 8/1987 | Japan . | |
| 1-224776 | 9/1989 | Japan . | |
| 2-073366 | 3/1990 | Japan . | |
| 4-039671 | 2/1992 | Japan . | |
| 4-039672 | 2/1992 | Japan . | |
| 5-034978 | 2/1993 | Japan . | |
| 2159972 | 12/1985 | United Kingdom | G03G 9/08 |

*Primary Examiner*—Roland Martin

*Attorney, Agent, or Firm*—Fitzpatrick, Cella, Harper & Scinto

[57] ABSTRACT

A color toner having color toner particles containing a coloring agent and a non-linear polyester resin synthesized from a compound represented by the following general formula (1) or an acid anhydride thereof;

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, the pigment particles in the color toner particles have a number average diameter of no greater than 0.7 μm and contain at least 60 percent by number of the pigment particles having a diameter of 0.1 to 0.5 μm and no greater than 10 percent by number of the pigment particles having a diameter of at least 0.8 μm, and the color toner has a softening temperature of 85° C. to 120° C. calculated from a flow tester curve.

66 Claims, 2 Drawing Sheets

COLOR TONER, TWO-COMPONENT TYPE DEVELOPER, IMAGE FORMING APPARATUS, COLOR IMAGE FORMING METHOD AND PROCESS FOR PRODUCING A COLOR TONER

BACKGROUND OF THE INVENTION

Field of the Invention and Related Art

The present invention relates to a color toner for developing electrostatically charged images in the fields of electrophotography, electrostatic recording, and electrostatic printing, and, in particular to a color toner having excellent color reproducibility in color images and excellent offset durability, a developer using the color toner for developing electrostatic images, an image forming apparatus, color image forming method and a process for producing a color toner.

In recent years, full-color copying machines have increasingly attracted attention, and especially digitalized full-color copying machines.

In a color image forming process of full-color electrophotography, the color is generally reproduced by using three colors of yellow, magenta, and cyan, or optionally by adding black.

A general color image forming method is as follows; first, rays of light from a document form an electrostatic latent image on a photoconductive layer through color separation light transmission filters which have complementary colors to the respective toners' color. Next, the toner is held on a toner image supporting member through developing and transfer steps. The steps are repeated several times while adjusting registration to overlap toner images on the same supporting member. A final full-color image can be obtained by a fixation step.

The fixation characteristics of the color toners are significantly important in color electrophotography which requires a plurality of developing steps and overlapping of various color toner layers on the same supporting member during the fixation steps.

The fixed color toners require appropriate gloss, and any irregular reflections due to the toner particles must be reduced as much as possible. Further, the color toners require sufficient transparency that any upper toner layer does not inhibit or interfere with the lower toner layers, each having a different tonality.

The present inventors have disclosed combinations of novel binder resins and coloring agents for color toners satisfying the above demands in Japanese Patent Laid-Open No. 50-62442, 51-144625, and 59-57256. The disclosed color toners have considerable sharp melting characteristics. Further, in the combination with silicone rubber rollers enabling the coating of silicone oils, the toners can be almost completely melting during the fixing step and still show desirable gloss and color reproducibility.

These effects demonstrate that, for the fixing characteristics of toners, the viscosity factor is more important than the elasticity factor in the viscoelasticity of the binder resins. Namely, the toners preferentially show the behavior as the viscosity factor during heating so that the hot melt characteristics are enhanced and gloss appears in the toners.

A binder resin design, which weighs such a viscosity factor, necessarily causes a decreased intermolecular cohesive force during the hot melt process and increased toner scale on the hot rollers during passing through the fixation apparatus. These problems easily bring about high temperature offset.

When using silicone rubber rollers as the fixing rollers particularly, the high temperature offset easily occurs during repeated operation due to the decreased releasing property inherent in the silicone rubber rollers independently of the coating of a release agent. At the initial stage when using the silicone rubber rollers, the releasing property can be maintained to some extent due to the silicone oil impregnated in the silicone rubber and the smooth, clean surface of the rollers. However, during continuous color copy operation of a large image size and significantly high toner holding content on the supporting member, such as an ordinary paper compared with monochrome copy, the oil in the silicone rubber will become exhausted and the roller surface will roughen so that the releasing property of the roller will gradually decrease. The deterioration speed of the roller is almost several times as fast as that in monochrome copying.

Moreover, the toners themselves have less elasticity as mentioned above resulting in decreased offset resistance of the toners. Thus, the high temperature offset is observed after only a few thousand to tens of thousand copies; coatings and scales of the toners form on the fixing roller surface; and the upper toner layers are peeled off from the imaged surface during passage through the nip of the hot roller.

Various attempts have been made to solve or decrease the above problems on toners and further improvements are required. For example, a release agent such as low molecular weight polyethylene, polypropylene, wax, and higher fatty acids is added to the toner in order to increase its releasing property as described in Japanese Patent Laid-Open No. 55-60960, 57-208559, 58-11953, 58-14144, and 60-123852. Although these methods are effective for preventing offset, a high content of release agent unsatisfactorily decreases the miscibility with the biding resin, resulting in the following harmful effects; loss in transparency of projected color image by OHP (over-head projector), unstable electrostatic charge, and decreased durability.

In Japanese Patent Laid-Open Nos. 47-12334, 57-37353, and 57-208559, toners containing non-linear polyester copolymers as a binder are proposed. The polyester copolymers are obtained from monomer components including etherized bisphenol monomers, dicarboxylic acid monomers, trivalent or higher polyhydric alcohol monomers and/or trivalent or higher polycarboxylic acid monomers. Such prior art seeks to prevent offset by containing the polyester binder, which is obtained by crosslinking polyester comprising etherized bisphenol and dicarboxylic acid monomers with a large quantity of the polyhydric alcohol and/or polycarboxylic acid monomers, in the toner. However, those toners have somewhat high softening temperatures and do not show satisfactory fixing characteristics at a low temperature. Further, although the high temperature offset reaches a practical level for full-color copying, mixing property and reproducibility of the colors based on the overlap of the full-color toners are unsatisfactory due to poor fixation and melt characteristics. In Japanese Patent Laid-Open Nos. 57-109825, 62-78568, and 62-78569, as well as Japanese Patent Laid-Open Nos. 59-7960 and 59-29256 by the present inventors, the toners containing polyester binders are disclosed, in which the polyester is a non-linear copolymer obtained from an etherized bisphenol monomer, a dicarboxylic acid monomer substituted with higher aliphatic hydrocarbon and another dicarboxylic acid monomer, a trivalent or higher polyalcohol monomer and/or a trivalent or higher polycarboxylic acid monomer. The polyester has a side chain having a saturated or unsaturated aliphatic hydrocarbon group of 3 to 22 carbon atoms. These polyester binders are intended for use in high speed copying machines, and to meet the weight elasticity factor of the viscoelasticity of the resin, in contrast to the above viscosity factor weighted polyester, resulting in increased elasticity and drastically decreased high temperature offset to the roller. Here, the pressure and temperature of the hot roller are raised as much as possible during the fixation, and toners are squeezed into the spaces between fibers of the transferred sheet in a semi-melted state, so as to be fixed at a high pressure and temperature.

Thus, continuous coating formation and smooth surface formation due to melting of the toner layers, which are essential for color copying, are practically impossible. As a result, fixed toners exist in a particulate state on the transfer paper, and the obtained color image is subdued and has low color saturation. In the image on the transparent sheet, the light scatters and diffuses on the surface of the toner particles impractically reducing light transmittance.

The present inventors have proposed novel polyester resins having excellent high temperature offset resistance and applicable to color copying in Japanese Patent Laid-Open Nos. 2-73366 and 1-224776. These resins have excellent properties compared with conventional resins for the color toners. However, the offset prevention to the fixing rollers is effective only for 20 to 50 thousand times of repeated operation. Considering that, in the monochrome toner, printing durability and offset resistance for a few hundred thousand copies are required in spite of the conventional life span of somewhat more than one hundred thousand copies, these properties in the color toner are desired to be further improved. Because these polyester resins have a great difference in electrostatic chargeability between a low temperature-humidity atmosphere and a high temperature-humidity atmosphere, in color imaging after repeated copying, the image density is somewhat deduced at a low humidity atmosphere, and toner scattering and fog sometimes occur at a high humidity atmosphere.

Polyester resins are disclosed in Japanese Patent Laid-Open Nos. 62-195676, 62-195678 and 62-195680, in which the ratio of hydroxyl number to acid number are limited. These polyester resins are intended for high speed fixing, and the color toners using such polyester resins do not provide satisfactory color mixing properties according to the present inventors.

As a marked characteristic of color copying, harmonization of at least three colors and preferably four color toners, is essential. Therefore, the improvement in the fixing property and color reproducibility of only certain colors is not effective, so the overlap and harmonization of the four color toners must be considered concerning the resin design and selection.

Because almost all colors can be reproduced theoretically by subtractive color mixing from three primary colors, i.e. yellow, magenta and cyan, the full-color copying machines in the current market operate by overlapping the three primary color toners. Therefore, although all tonalities can be realized in all density ranges in the ideal state, some areas for improvement still remain; for example, the spectroreflective and overlapping characteristics of the toners, the mixing properties during fixing, and the color saturation.

When obtaining black color by the overlap of the three primary colors, because three separate toner layers must be formed on the transfer paper, it is more difficult to improve the offset resistance compared with monochrome copying.

Further, the demand for high quality is further increasing concerning the full-color copied image. The ordinary customers, who have been used to seeing high quality color prints, are still not satisfied with full-color copy images, and require a quality very similar to prints or photographs, i.e. a solid image in a wider range of the copy image, homogeneous half-tone image, toners which provide high density images covering wider dynamic ranges, and transparent sheet images having a transparency similar to prints and transparency of the conventional toners.

The quickest and easiest method for satisfying these demands is to improve the dispersibility of the coloring agents existing in the toners. Japanese Patent Laid-Open Nos. 61-117565 and 61-156054 disclose methods, in which the toners are prepared by dissolving binder resins, coloring agents, and charge controlling agents into solvents and then removing the solvents. However, these methods have some problems; the difficult control of dispersibility of the charge controlling agents, and undesirable smell due to the solvents remaining in the formed toners.

A method for producing a toner by using halogenous solvents is disclosed in Japanese Patent Laid-Open No. 61-91666. However, the method has some drawbacks. For example, the usable coloring agents are limited due to the strong polarity of halogenous solvents.

Methods for producing toners in a kneader at a high temperature and pressure are disclosed in Japanese Patent Laid-Open Nos. 4-39671 and 4-39672. The methods are suitable for providing better dispersibility of coloring agents. However, molecular chains of the binder resins in toners are severed by excessive loading during mixing. As a result, a partial formation of low molecular weight polymer is promoted and high temperature offset readily occurs during the fixing process. In color copies particularly, because three or four fold color toner layers must be fixed, the latitude of the high temperature offset resistance is extremely restrictive compared with the monochrome toners so that only a small degradation of the polymer molecules readily causes high temperature offset.

In Japanese Patent Laid-Open No. 5-34978, the dispersion of a pigment into a resin is disclosed by feeding aqueous pressed cake of the pigment and resin and mixing with heat. The method provides desirable dispersibility of the pigment. However, the method does not mention the resin characteristics. The method differs from the present invention in the following points; a toner of the present invention has well balanced properties by using a resin designed so as to improve not only the fixing characteristics and offset resistance, but also dispersibility of the pigment. Thus, in the present invention, a desirable dispersion particle size of the pigment, good compatibility of the offset resistance and fixing characteristics, and improved color reproducibility can be achieved at the same time.

SUMMARY OF THE INVENTION

It is an object of the present invention to provide a color toner having an excellent fixing property and color mixing characteristics, a two-component type developer using this color toner, an image forming apparatus using this color toner, a color image forming method using this color toner, and a process for producing a color toner.

It is another object of the present invention to provide a color toner having satisfactory triboelectric chargeability, a two-component type developer using this color toner, an image forming apparatus using this color toner, a color image forming method using this color toner, and a process for producing a color toner.

It is further object of the present invention to provide a color toner having excellent gloss characteristics producing extremely high quality of image, a two-component type developer using this color toner, an image forming apparatus using this color toner, a color image forming method using this color toner, and a process for producing a color toner.

It is still another object of the present invention to provide a color toner which can prevent the high temperature offset and has a wide range of fixing temperature, a two-component type developer using this color toner, a color image forming apparatus using this color toner, a color image forming method using this color toner, and a process for producing a color toner.

It is still further object of the present invention to provide a color toner maintaining satisfactory offset resistance after repeated fixing steps and which prevents winding up of the paper to the fixing roller, a two-component type developer using this color toner, an image forming apparatus using this color toner, a color image forming method using this color toner, and a process for producing a color toner.

It is another object of the present invention to provide a color toner which does not adhere onto a developing device such as a developing sleeve, blade and coating roller, a two-component type developer using this color toner, an image forming apparatus using this color toner, a color image forming method using this color toner, and a process for producing a color toner.

It is further object of the present invention to provide a color toner which does not film on the surface of a photosensitive material, a two-component type developer using this color toner, an image forming apparatus using this color toner, a color image forming method using this color toner, and a process for producing a color toner.

It is still another object of the present invention to provide a color toner having excellent coloring agent dispersibility in the color toner particles, a two-component type developer using this color toner, an image forming apparatus using this color toner, a color image forming method using this color toner, and a process for producing a color toner.

It is further object of the present invention to provide a color toner enabling one to obtain a high density image due to high coloring ability, a two-component type developer using this color toner, an image forming apparatus using this color toner, a color image forming method using this color toner, and a process for producing a color toner.

It is another object of the present invention to provide a color toner having satisfactory color saturation and transparency, a two-component type developer using this color toner, an image forming apparatus using this color toner, a color image forming method using this color toner, and a process for producing a color toner.

These and other objects are attained by a color toner comprising:

color toner particles comprising a coloring agent and a non-linear polyester resin, said polyester resin synthesized from at least a tri- or higher carboxylic acid compound represented by the following general formula (1) or an acid anhydride thereof:

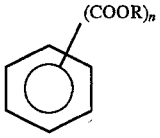

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, wherein said coloring agent is formed from pigment particles, said pigment particles in said color toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said color toner has a softening temperature of 85° C. to 120° C. calculated from a flow tester curve.

It is another object of the present invention to provide a two-component type developer comprising:

a color toner comprising color toner particles and a carrier, wherein said color toner particles comprise a coloring agent and a non-linear polyester resin, said non-linear polyester synthesized from at least a tri- or higher carboxylic acid compound represented by the following general formula (1) or an acid anhydride thereof:

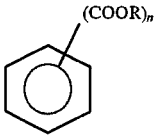

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, wherein said coloring agent is formed from pigment particles, said pigment particles in said color toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said color toner has a softening temperature of 85° C. to 120° C. calculated from a flow tester curve.

It is further object of the present invention to provide an image forming apparatus comprising:

a latent image holding member for holding an electrostatic latent image, and a developing device for developing the electrostatic latent image on said latent image holding member, said developing device comprising:

(i) a developer container containing a non-magnetic one-component developer;

(ii) a developer holding member for holding said non-magnetic one-component developer; and (iii) a developer coating member for coating said non-magnetic one-component developer on said developer holding member so as to form a thin layer of said non-magnetic one-component developer on said developer holding member;

wherein said non-magnetic one-component developer comprises a color toner comprising color toner particles comprising a coloring agent and a non-linear polyester resin, said polyester synthesized from at least a tri- or higher carboxylic acid compound represented by the following general formula (1) or an acid anhydride thereof:

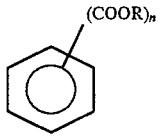

(1)

wherein n is an integer of at least 3, R is a hydrogen atom, an alkyl group having 1 to 18 carbon atoms, an alkenyl group having 2 to 18 carbon atoms, or an aryt group having 6 to 18 carbon atoms, said coloring agent is formed from pigment particles, said pigment particles in said color toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said color toner has a softening temperature of 85° C. to 120° C. calculated from a flow tester curve.

It is another object of the present invention to provide a color image forming method comprising:

forming a color toner image on a recording material using at least one color toner selected from the group of a cyan toner, a magenta toner, and a yellow toner, and obtaining a color image by fixing with heat said color toner image formed on said recording material;

wherein said cyan comprises cyan toner particles comprising a coloring agent and a non-linear polyester resin, said polyester synthesized from at least a tri- or higher carboxylic acid compound represented by the following general formula (1) or an acid anhydride thereof:

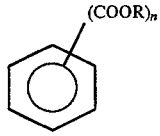

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, said coloring agent is formed from cyan pigment particles, said cyan pigment particles in said cyan toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said cyan toner has a softening temperature of 85° C. to 120° C. calculated from a flow tester curve;

said magenta toner includes a coloring agent and magenta toner particles containing a non-linear polyester resin synthesized from a compound having the general formula (1) or an acid anhydride thereof:

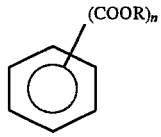

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, said coloring agent is formed by magenta pigment particles, and said magenta pigment particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said yellow toner has a softening temperature of 85° C. to 120° C. calculated from a flow tester curve;

said yellow toner comprises yellow toner particles comprising a coloring agent and a non-linear polyester resin, said polyester synthesized from at least a tri- or higher carboxylic acid compound represented by the following general formula (1) or an acid anhydride thereof:

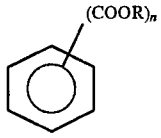

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, said coloring agent is formed from yellow pigment particles, said yellow pigment particles in said yellow toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said yellow toner has a softening temperature of 85° C. to 120° C. calculated from a flow tester curve.

It is further object of the present invention to provide a process for producing a color toner comprising the steps of:

heating while mixing at a non-pressurized condition (i) a first binder resin containing a non-linear polyester resin, said polyester synthesized from at least a tri- or higher carboxylic acid compound represented by the following general formula (1) or an acid anhydride thereof:

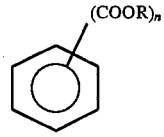

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, and (ii) a paste pigment containing a dispersive medium and 5 to 50 weight percent of pigment particles insoluble in said dispersive medium;

combining the pigment particles in said paste pigment to the heated first binder resin;

melt-kneading said first binder resin with said pigment particles to obtain a first kneaded product;

drying said first kneaded product;

melt-kneading said dried first kneaded product with at least a second binder resin to obtain a second kneaded product; and pulverizing said second kneaded product after cooling to obtain color toner particles;

wherein said pigment particles in said color toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said color toner has a softening temperature of 85° C. to 120° C. calculated from a flow tester curve.

Further objects, features and advantages of the present invention will become apparent from the following description of the preferred embodiments with reference to the attached drawings.

DETAILED DESCRIPTION OF THE PREFERRED EMBODIMENTS

Figure 1:
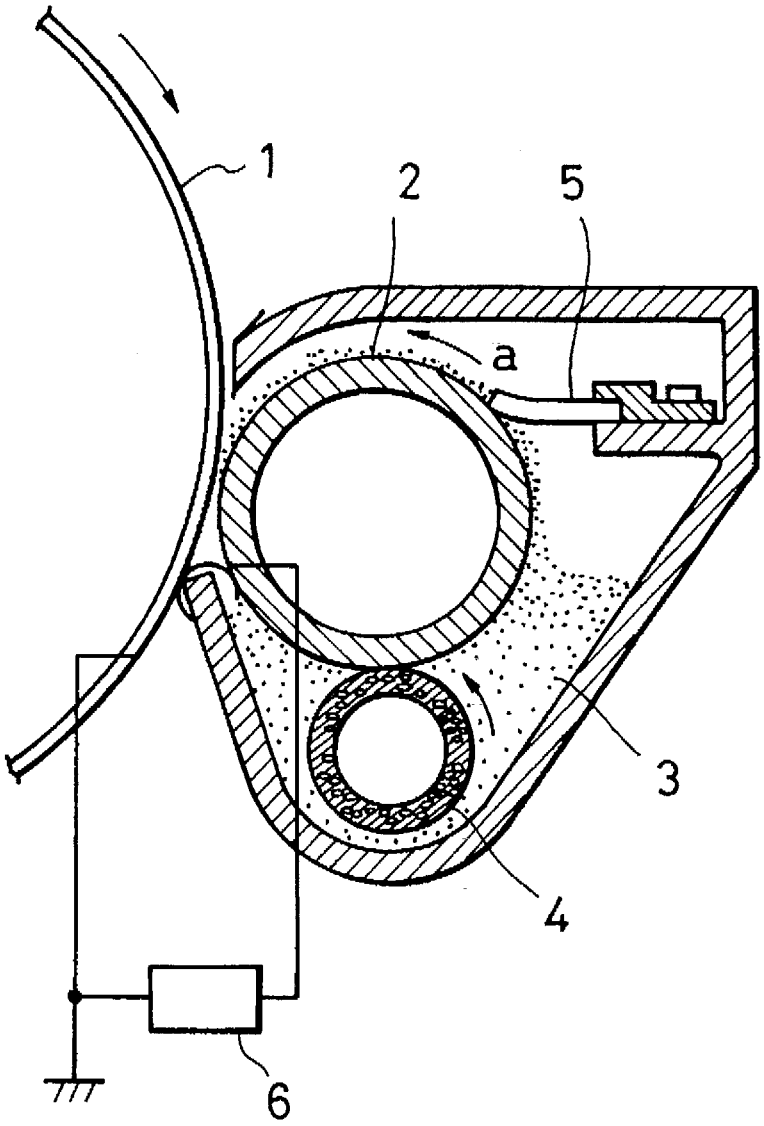
FIG. 1 is a diagrammatic representation showing an embodiment of a developing device using a non-magnetic one-component developer having a color toner of the present invention.

The inventors of the present inventors have carried out intensive investigations on fixing property, color reproducibility, highlight reproducibility, triboelectric charge stability, cleaning characteristics and transferring characteristics of toners. As a result, the inventors found for the first time that a color toner, which does not exert a harmful influence on the offset resistance and has excellent color reproducibility, can be obtained when the binder resin includes a non-linear polyester resin, said polyester formed by reacting (i) a linear polyester resin comprising condensed repeating units of a diol component and a dicarboxylic acid component and (ii) a tri- or higher carboxylic acid compound, said tri- or higher carboxylic acid compound represented by the following general formula (1) or an acid anhydride thereof:

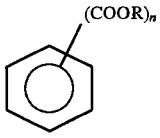

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, and the pigment particles forming the coloring agent have a specified dispersive particle size in the color toner particles as described below. The R groups can be the same or different in the tri- or higher carboxylic acid compound of formula (1).

The binder resin of the present invention is a polyester having a weak crosslinking structure, which is preferably obtained by regularly introducing a trivalent or higher polycarboxylic acid as a crosslinkable monomer in a linear polymer chain comprising repeated units of a diol component and a dicarboxylic acid component. In spite of the weak crosslinked structure, since all the polymeric molecules form a crosslinked network or the like, the polymer shows significantly improved offset resistance compared with a simple linear polymer. Linear and non-linear polyester resins of the present invention are shown in U.S. Pat. No. 5,346,792, issued Sep. 13, 1994, the disclosure of which is incorporated herein by reference. The degree of the crosslinking of the binder resin should be such that it is within a range such that the heat mobility of the binder resin is not hindered. Additionally, by taking into account the composition and quantity of the monomer components as well as the degree of the crosslinking, a full-color image having excellent color mixing property and color reproducibility can be obtained. However, a color reproducibility of the crosslinked polymer can be somewhat inferior to that of a common linear polymer having sharp melt characteristics.

Accordingly, in the present invention, compatibility between the improved offset resistance and the color reproducibility or color mixing property can be achieved by highly dispersing the coloring agent, i.e. by controlling the dispersive particle size of the pigment particles in the color toner particles so that the pigment particles in the color toner particles have a number average diameter of no greater than 0.7 μm and contain at least 60 percent by number of the pigment particles having a diameter of 0.1 to 0.5 μm and no greater than 10 percent by number of the pigment particles having a diameter of at least 0.8 μm.

The inventors of the present invention found that only when homogeneously dispersed pigment particles in the toner particles are formed by controlling the dispersive particle size of the pigment particles as described above, that all the tonality can be reproduced, even if the toners containing the above bonding resin overlap, and ideal tonality by the subtractive process can be realized in various density ranges.

If average particle size by number is more than 0.7 μm of the pigment particles in the color toner particles, then a large number of insufficiently dispersed pigment particles exist. That results in poor color reproducibility and reduced transparency of the image projected by the OHP. Further, if the pigment particles inhomogeneously exist as agglomerates in the toner particles, irregular electrification between the toner particles is clearly observed and the so-called distribution of triboelectric charge becomes broad. Thus, a high quality full-color image cannot be obtained.

Moreover, the present invention has another feature in that the pigment particles in the color toner particles contain at least 60 percent by number of the pigment particles having a diameter of 0.1 to 0.5 μm. In investigations on the dispersive particle size of the coloring agent, only the average particle size has been regarded as an important factor so far. In contrast, the present inventors found that the dispersive particle size distribution of the pigment particles dispersed in the color toner particles is an extremely important factor for improving color reproducibility.

More specifically, when the dispersive particle size distribution of the pigment particles is broad, the extent of the dispersion of the coloring agent between the toner particles is significantly and unavoidably varied. In this case, even if the average particle size decreases, irregular reflection of the light due to the relatively large coloring agent particles not being sufficiently dispersed occurs which results in unsatisfactory color reproducibility. In the subtractive process conducted by overlaying three colors of magenta, cyan, and yellow, in particular, the pigment is desired to have as sharp a dispersive particle size distribution as possible in order to fully reveal the spectroscopic reflection characteristics of the coloring agent.

It is generally considered that fine pigment particles less than 0.1 μm in size do not exert adverse influence on light reflection and adsorption characteristics and can provide excellent color reproducibility and transparency of an image projected by OHP. On the other hand, a large number of coarse pigment particles more than 0.5 μm in diameter inevitably cause reduced brightness or color separation of the projected image.

Accordingly, in the present invention, the pigment particles contain 60 percent or more, desirably 65 percent or more, and preferably 70 percent or more, by number of the pigment particles in the color toner particles having a diameter of 0.1 to 0.5 μm.

Moreover, the present invention has an added feature that the pigment particles contain 10 percent or less by number of the pigment particles in the color toner particles having a diameter of 0.8 μm or more. Basically, it is desired that the coarse particles having a diameter of 0.8 μm or more exist in as small numbers as possible. In amounts over 10 percent, they are unavoidably eliminated from the toner surface which results in various problems such as fog, drum contamination, poor cleaning property and the like, particularly where the pigment particles exist near the toner surface.

When using the color toner of the present invention to make a two-component type developer, carrier contamination also occurs, if a conventional process is used. A stable image cannot be obtained after long term operation. Thus, the excellent color reproducibility and homogeneous charge property cannot be achieved.

To overcome this problem a unique dispersion method of the pigment particles is provided to achieve the objects of the present invention.

In conventional methods in which mixing is carried out at a high temperature or in a pressurized atmosphere, chain scission of the resin polymer readily occurs so that the intended objects; i.e. improvement in offset resistance and high quality color image, are not attainable.

It is another feature of the present invention, that in order to reach the dispersion state specified above of the pigment particles in the color toner particles, a first binder resin and a paste pigment containing 5 to 50 weight percent of the pigment particles which are insoluble in the dispersive medium are fed to a kneader or mixer and then heated while mixing at a non-pressurized condition, so as to melt the first binder resin. After the paste pigment, i.e. the pigment in the liquid phase, is distributed or migrates into the heated first binder resin, i.e. melt resin phase, the first binder resin and the pigment particles are kneaded with melting and the liquid component is evaporated to dryness in order to obtain a first kneaded material comprising the first binder resin and the pigment. Then, the second binder resin and any optional additives, such as electric charge controlling agent, are added to the first kneaded material and kneaded with heat and melting so as to obtain the second kneaded material. It is desirable that the obtained second kneaded material is pulverized to toner particles after cooling.

The above paste represents a state in which the pigment particles exist through out any drying process in the pigment particle producing process; in other words, that the pigment particles exist in a state of almost primary particles in amounts of 5 to 50 weight percent based on the total weight of the paste. The residual portion of 50 to 95 weight percent in the paste substantially consists of volatile liquid with a small quantity of a dispersant and a dispersion promoter. Although any volatile liquid can be used without limitation, water is preferably used in the present invention for environmental reasons.

The phrase "insoluble pigment particles" as used in the present invention mean the pigment particles which are insoluble in the volatile liquid used as the dispersive medium in the paste and are dispersed in the paste. For example, when selecting water as the dispersive medium, all the pigment particles insoluble in water are defined as the insoluble pigment particles.

The paste pigment used in the present invention contains 5 to 50 weight percent, and preferably 5 to 45 weight percent of the insoluble pigment particles in water. Because a content of over 50 weight percent brings about low dispersion efficiency in the resin, higher kneading temperature or longer kneading time are required. Further, strong screws and paddles are essential for the kneading apparatus, which promotes scission of the polymer chains. On the other hand, where the paste pigment is a solid component and the content of the insoluble pigment is less than 5 weight percent, a large quantity of the paste pigment must be fed into the apparatus in order to obtain a predetermined pigment content, so that a large-scale apparatus is inevitably required. Further, water must be completely eliminated by enhancing the water removing ability of the process after the first mixing step, which results in a great load to the resin.

When kneading or mixing the paste pigment with the resin, the ratio of the pigment particles converted into the solid component to the resin is desirably 10:90 to 50:50, and preferably 15:85 to 45:55. When the ratio of the pigment particles to the resin is less than 10 weight percent, a large quantity of the resin relative to the paste pigment must be fed into the kneader so that the segregation of the pigment particles easily occurs in the kneaded material. In order to provide a homogeneous system, a longer kneading time has to be set. Thus, the resin undergoes excessive load and loses the desired characteristics. On the other hand, when a content of the pigment particles to resin is more than 50 weight percent, the migration of the pigment particles in the liquid resin phase cannot proceed. Further, in the melt-kneading step after the migration of the pigment particles, the kneaded product does not show a homogeneous melt state resulting in poor dispersibility.

As the method for achieving the above-specified dispersion of the pigment particles in the color toner particles, when the second kneaded product is obtained by melt-kneading of the first kneaded product with at least the second binder resin, the kneading is desirably carried out in such a state that the second kneaded product undergoes sufficient shear by using an organic metal complex. By using the organic metal complex, the specified non-linear polyester resin as the first binder resin and the organic metal complex react each other to form metallic crosslinks during melt-kneading. Since the crosslink density and viscosity of the second kneaded product increase with this reaction, the second kneaded product undergoes sufficient shear. The method without the organic metal complex can also be employed by changing the kneading condition, for example by decreasing the kneading temperature which causes sufficient shear to the second kneaded product. However, the former method is preferably used in order to obtain a finer and more homogeneous dispersion of the pigment particles, and to sharpen the dispersive particle distribution of the pigment particles in the second kneaded product.

Moreover, as the method for attaining the above-specified distribution state of the pigment particles in the color toner particles, instead of the method using the above paste pigment, one can increase the number of kneading cycles, i.e. to five times or more, and desirably, to eight times or more when obtaining the first kneaded product by melt-kneading the first binder resin and the dry powdered pigment particles in order to perform more sufficient kneading than by conventional methods. However, when improving the dispersibility of the pigment particles by increasing the number of kneading cycles, because the first binder resin undergoes mechanical stress, polymer chain scission of the first binder resin easily occurs, resulting in undesirable phenomena, such as decreased storage stability of the toner, and partial adhesion of the toner to the fixing roller after a large number of operations. Therefore, considering the durability of image forming after a large number of operations, the method using the paste pigment is preferable to the method using the dry pigment particles.

In order to perform the first kneading step at the non-pressurized condition in the present invention, it is more desirable that the binder resin has a softening temperature (Tm) of 85° C. to 115° C. calculated from a flow tester curve. When the softening temperature (Tm) of the binder resin is higher than 115° C., the melting of the resin is insufficient during the non-pressurized dispersion process, so the migration of the paste pigment from the aqueous phase into the melt resin phase does not smoothly occur, and the above particle sizes cannot be obtained. Further, although the resin having a softening temperature (Tm) of higher than 115° C. has excellent offset resistance, a higher fixing temperature has to be set. Even if the dispersion state of the pigment particles can be controlled, the surface smoothness in the image section drastically decreases and excellent color reproducibility cannot be attained.

In the resin having a softening temperature (Tm) of less than 85° C., the kneading step smoothly proceeds. However, the resulting toner has poor blocking resistance, and does not produce excellent offset resistance, even with the three dimensional crosslinked polyester.

The reason that melt-kneading is performed at a non-pressurized condition in the present invention is to prevent polyester resin alteration. Under a pressurized atmosphere, the liquid, for example water, in the paste pigment vigorously attacks the polyester resin and hydrolysis or alteration of the polyester resin partly occurs. Thus, the effects due to the binder resin having a light crosslinking structure are sometimes canceled out. Accordingly, in the present invention, the melt-kneading of the first binder resin with the paste pigment is preferably carried out at a non-pressurized condition.

Examples of the kneading apparatus used in the present invention are a heating kneader, a uniaxial extruder, a biaxial extruder and a kneader. Between them, the heating kneader is preferably used.

The color toner of the present invention can satisfy the above objects by using a binder resin satisfying both excellent offset resistance and high quality of full-color image, as well as by efficiently and highly dispersing the coloring agent into the binder resin in the color toner producing process while maintaining the characteristics of the binder resin.

The color toner of the present invention has a feature that the softening temperature (Tm) is in the range of 85° C.≦Tm≦120° C. calculated from the flow tester curve. When the softening temperature (Tm) of the toner is higher than 120° C., although providing excellent offset resistance, a higher fixing temperature is required. Further, even if the dispersibility of the pigment particle is controllable, the surface smoothness in the image section significantly decreases so the excellent color reproducibility cannot be attained. On the other hand, when the softening temperature (Tm) of the toner is lower than 85° C., the surface of the fixed image is certainly smooth and bright. However, offset after long-term operations will readily occur. Further, the storage stability is poor and a new problem of adhesion of the toner in the developing container may occur. Accordingly, the softening temperature (Tm) of the color toner is suitably 85° C.≦Tm≦120° C., and preferably 90° C.≦Tm≦115° C.

In the color toner of the present invention, as mentioned above, the softening temperature (Tm) of the color toner is in the range of 85° C. to 120° C., the specified non-linear polyester resin is used as the binder resin of the color toner, and the pigment particles in the color toner particles show the specified dispersion state. As a result, the color toner of the present invention has excellent dispersibility of the pigment particles in color toner particles compared with conventional color toners, and excellent color reproducibility. Further, transparency of the color image fixed on a transparent film can be achieved even if the lower gloss value of the fixed color image is set by fixing the color image at a lower fixing temperature than conventional fixing temperatures.

Examples of the pigment particles useful to attain the objects of the present invention are chromatic pigments and black/white pigments. Organic pigments having excellent oleophilic properties are preferable. For example, Naphthol Yellow S, Hanza Yellow G, Permanent Yellow NCG, Permanent Orange GTR, Pyrazolone Orange, Pyrazolone Orange G, Permanent Red 4R, the calcium salt of Watchung Red, Brilliant Carmine 3B, Fast Violet B, Methyl Violet Lake, Phthalocyanine Blue, Fast Sky Blue, and Indanthrene Blue BC are used.

Pigments having high light resistance, such as polyfused azo pigments, insoluble azo pigments, quinacridone pigments, isoindolenone pigments, perillene pigments, anthraquinone pigments, and copper phthalocyanine pigments are preferably used.

Examples of preferable magenta pigments are C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238; C.I. Pigment Violet 19; C.I. Vat Red 1, 2, 10, 13, 15, 23, 29, and 35.

Examples of preferable cyan pigments are C.I. Pigment Blue 2, 3, 15, 16, and 17; C.I. Vat Blue 6; C. I. Acid Blue 45 and copper phthalocyanine pigments in which phthalocyanine skeleton having the structure as shown in the following formula (2) is substituted with one to five phthalimidemethyl groups:

(2)

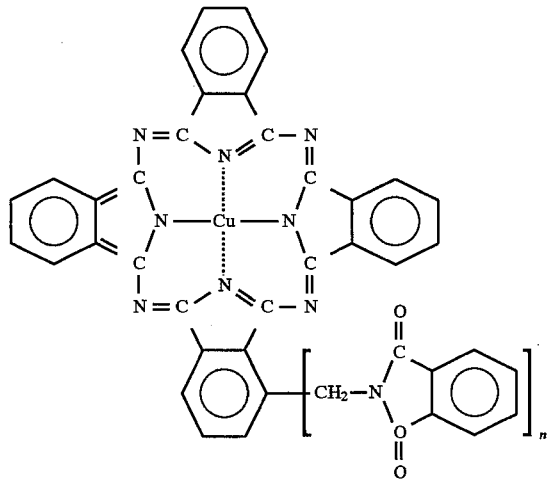

n = 1~5

Examples of preferable yellow pigments are C.I. Pigment Yellow 1, 2, 3, 4, 5, 6, 7, 10, 11, 12, 13, 14, 15, 16, 17, 23, 65, 73, 74, 81, 83, 93, 96, 97, 98, 109, 117, 120, 137, 138, 139, 147, 151, 154, 167, 173, 180, 181, and 183; C.I. Vat Yellow 1, 3, and 20.

In the present invention, the paste pigments, which are obtained from the slurry pigments before the filtration process in the conventional pigment production processes without a through drying process, are preferably used rather than the pigments made by the reduction of powdered dry pigments to aqueous pastes.

The content of the yellow pigment is usually less than 12 parts by weight, and preferably 0.5 to 7 parts by weight, based on 100 parts by weight of the binder resin, because the yellow toner sensitively affects the transparency of the transparent image by the OHP. The content of over 12 parts by weight causes less reproducibility of green and red, which are the mixed colors of yellow, and of the flesh colors in the human bodies' images.

The content of each of magenta and cyan pigment in the magenta and cyan toner is usually less than 15 parts by weight, and preferably 0.1 to 9 parts by weight, based on 100 parts by weight of the binder resin.

The dibasic acid component of polyester resins preferably used in the present invention are, for example, aromatic dicarboxylic acids, such as terephthalic acid, isophthalic acid, phthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid, and 1,2-diphenoxyethane-p,p'-dicarboxylic acid; maleic acid, fumaric acid, glutaric acid, cyclohexane-dicarboxylic acid, succinic acid, malonic acid, adipic acid, mesaconic acid, itaconic acid, citraconic acid, sebacic acid, and anhydrides and esters of all the above acids.

The dihydric alcohols are preferably the diols expressed as the following formula (3):

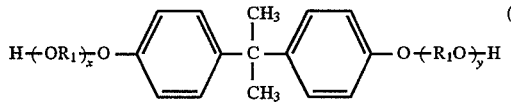

(3)

where, $R_1$ represents an alkylene group having 2 to 5 carbon atoms,and each of X and Y represents a positive integer satisfying the equation $2 \leqq X+Y \leqq 6$. Examples of typical dihydric alcohols are polyoxypropylene (2.2)-2,2-bis (4-hydroxyphenyl) propane, polyoxyethylene (2.0)-2,2-bis (4-hydroxyphenyl)propane, polyoxypropylene (6.0)-2,2-bis (4-hydroxyphenyl)propane, and polyoxypropylene(13.0)-2, 2-bis(4-hydroxyphenyl)propane.

Other dihydric alcohols can also be used as exemplified below; diols such as ethylene glycol, diethylene glycol, triethylene glycol, 1,2-propylene glycol, 1,3-propylene glycol, 1,4-butanediol, neopentyl glycol, and 1,4-butenediol; 1,4-bis(hydroxymethyl)cyclohexane; and bisphenol A and hydrogenated bisphenol A.

As described above, the polyester resins of the present invention must include the compound represented by the following general formula (1) or an anhydride thereof as an essential component:

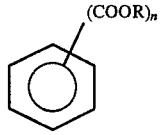

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms. R is either the same or different from each other in the compound —COOR groups.

The preferred compounds represented by the above formula (1) are more specifically shown as the following formulae (4) through (8):

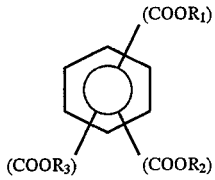

(4)

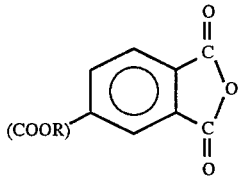

(5)

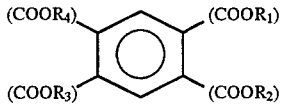

(6)

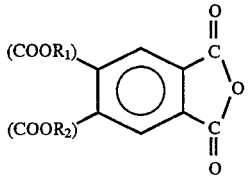

(7)

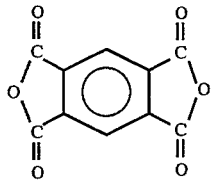

(8)

Examples of the compounds having the above formulae are trimellitic acid, tri-n-ethyl 1,2,4-tricarboxylate, tri-n-butyl 1,2,4-tricarboxylate, tri-n-hexyl 1,2,4-tricarboxylate, tri-isobutyl 1,2,4-benzenetricarboxylate, and tri-2-ethylhexyl 1,2,4-benzenetricarboxylate. Other compounds satisfying the above formulae can also be similarly used without any limitation.

The polyester resins of the present invention may include acids having alkyl or alkenyl groups such as maleic acid, fumaric acid, glutaric acid, succinic acid, malonic acid, and adipic acid, in which these acids have a n-dodecenyl group, iso-dodecenyl group, n-dodecyl group, iso-dodecyl group, or iso-octyl group; and/or alcohols such as ethylene glycol, 1,3-propylenediol, tetramethylene glycol, 1,4-butylenediol, and 1,5-pentyldiol.

A method for producing the polyester resin used for the toners of the present invention is, for example, as follows: First, a linear condensation polymer is prepared in which the molecular weight is adjusted so that the acid value and hydroxyl value each is 1.5 to 3 times of the respective predetermined value and the molecular weight distribution is mono-dispersive. In order to achieve the above condition, the condensation reaction is controlled so as to proceed more slowly and gradually by the following means; (i) longer reaction time at lower temperature than conventional methods, (ii) decreased quantity of esterification agent, (iii) use of low reactivity esterification agent, or (iv) combinations thereof. Then, under the above conditions, an acid component for crosslinking, and an esterification agent, if necessary, are added to the reaction system to form a three-dimensional condensation product. The temperature is further raised so that the reaction proceeds gradually in order to obtain a mono-dispersive crosslinked polymer. The reaction is completed when either hydroxyl value, acid value or MI value is decreased to a predetermined value to obtain a final polyester resin product.

The color toner of the present invention should not be limited to either a negative chargeable toner or a positive chargeable toner. When using the color toner as a negative chargeable toner, any charge controlling agent can be preferably added in order to stabilize the negative charge property. Examples of a negative charge controlling agent are organic metal complex compounds, such as metallic complexes of alkyl substituted salicylic acids, for example, chromium or zinc complexes of di-tert-butyl salicylic acid.

When using the color toner as a positive chargeable toner, Nigrosine, triphenylmethane derivatives, Rhodamine dyestuffs, and polyvinylpyridine can be used as the positive charge controlling agent. In the process producing a color toner, it is desired to use a binder resin containing desirably 0.1 to 40 mol percent, and preferably 1 to 30 mol percent of esters of carboxylic acid having an amino group, for example dimethylaminomethyl methacrylate, which exhibit a positive charge property, and colorless or light color positive charge controlling agents not affecting the chromaticity of the color toner. Any adding method can be employed without limitation.

The desirable color toner of the present invention comprises a mixture of the color toner particles and additives. An example of a typical additive is a flowability improver for increasing the flowability the toner. Any flowability improver can be used by adding it to the resin particles containing the coloring agent. Examples of such flowability improvers include fluorocarbon resin powder, such as a polyvinylidene fluoride fine powder and polytetrafluoroethylene fine powder; metal salts of fatty acids, such as zinc stearate, calcium stearate and lead stearate; metal oxides and hydrophobic powders thereof such as titanium oxide powder, aluminum oxide powder and zinc oxide powder and silica fine powders prepared by wet or dry process and surface treated silica with surface treating agents, such as silane coupling agents, titanium coupling agents and silicone oils.

The color toner of the present invention can be used as both a two-component type developer and a one-component type developer.

When using the color toner as the two-component type developer, the following carriers can be used; for example, metals such as iron nickel, copper, zinc, cobalt, manganese, chromium, and rare earth metals, alloys thereof, oxides thereof; surface oxidized iron; and magnetic ferrite. The process for preparing the carrier is not limited.

Resin coated carriers prepared by coating the surface of the carrier with a resin is preferably used. The method for coating the resin to the surface of the carrier usable in the present invention is shown in U.S. Pat. No. 5,340,677, issued Aug. 23, 1994, and U.S. Pat. No. 5,129,354, issued Jul. 14, 1992, the disclosure of which is incorporated herein by reference. Example of the methods for coating the resin are a method wherein the coating material is dissolved or suspended in a solvent and is applied to the carrier core by spraying, and a method of coating by mixing a coating material powder with a carrier core.

Examples of the coating materials are, although differing from toner material to toner material, polytetrafluoroethylene, monochlorotrifluoroethylene polymer, polyvinylidene fluoride, silicone resins, polyester resins, styrene resins, acrylic resins, polyamide resins, polyvinylbutyral resins, Nigrosine, aminoacrylate resins, basic dyestuffs and lakes thereof, silica fine powders, alumina fine powders, and metal complexes or salts of dialkylsalicylic acids. These materials can be used solely or together.

The coating condition can be decided appropriately within the above-described condition. The content of coating material on the carrier is preferably 0.1 to 30 weight percent, and more preferably 1 to 30 weight percent based on the carrier weight.

The carriers are preferably 20 to 100 μm, more preferably 25 to 70 μm, and further preferably 25 to 65 μm in an average particle size.

A resin coated Cu-Zn-Fe ternary ferrite prepared by coating the ferrite with a fluorocarbon resin and/or styrene resin of 0.01 to 5 weight percent, and preferably 0.1 to 1 weight percent based on the carrier weight is an example of preferred embodiment. Examples of the mixed resins for coating are a fluorocarbon resin and styrene resin, such as polyvinylidene fluoride/styrene-methyl methacrylate resin and polytetrafluoroethylene/styrene-methyl methacrylate resin. The mixing ratio of these resins can be decided appropriately.

In the case of preparing a two-component type developer by mixing a carrier with a toner of the present invention, the mixing ratio for producing satisfactory results is preferably 1 to 15 weight percent, and more preferably 2 to 13 weight percent of the toner concentration in the developer. A toner content of less than 1 weight percent causes decreased image density, while a content of over 15 weight percent increases fog and toner scattering in the developing device resulting a shortened developer life.

When using the color toner of the present invention as a non-magnetic one-component type developer, the above magnetic carriers are not used, but the above-described flowability improver as an external additive is used according to need.

The image forming apparatus using the non-magnetic one-component developer containing the color toner of the present invention will now be explained below.

The image forming apparatus has a latent image holding member, holding an electrostatic latent image, and a developing device for developing the electrostatic latent image on the latent image holding member. The developing device has (i) a developer container for the non-magnetic one-component developer, (ii) a developer holding member, for holding the non-magnetic one-component developer, and (iii) a developer coating member for coating the non-magnetic one-component developer on the developer holding member so as to form a thin layer of the non-magnetic one-component developer on the developer holding member.

The operation of the image forming apparatus of the present invention will now be explained by using a diagrammatic representation of an embodiment of the developing device using the non-magnetic one-component developer shown in FIG. 1.

In the latent image holding member 1, the latent image is formed by electrophotographic processing means or electrostatic recording means not shown in the figure. The developer holding member 2 comprises a non-magnetic metal sleeve formed from aluminum or stainless steel. The non-magnetic one-component developer, which is stored in hopper 3 as a developer container, is fed on the developer holding member 2 by feeding roller 4. Further, the feeding roller 4 scrapes the developer on the developer holding member after developing. The developer fed on the developer holding member 2 is uniformly applied by a developer coating blade 5, which is a developer coating member elastically urging the non-magnetic one-component developer to the developer holding member 2, to form the thin layer of the non-magnetic one-component developer on the developer holding member 2. The urging pressure between the developer coating blade 5 and the developer holding member 2 is preferably 3 to 250 g/cm, and more preferably 10 to 120 g/cm as a line pressure to the axis direction of the sleeve. A pressure of less than 3 g/cm causes difficult homogeneous developer application, resulting a broad triboelectric charge distribution of the developer as well as fogging and toner scattering. On the other hand, a pressure of over 250 g/cm often brings about the coagulation or pulverization of the toner particles due to the excessive pressure to the toner particles. By adjusting the pushing pressure to 3 to 250 g/cm, the coagulation of the fine toner particles can be avoided and a predetermined electrification of the developer can be instantaneously secured. As the material of the developer coating blade 5, it is desirable to use any tribo-electrification material which is suitable for charging the developer to a desirable polarity.

Examples of suitable developer coating blades used in the present invention are elastic blades formed from a rubber such as a silicone rubber, a urethan rubber, and a styrene-butadiene rubber. The use of a conductive rubber is preferable because overcharging (charge-up) of the toner can be prevented. Further, as needed, the surface of the blade 5 may be coated, in particular, with a resin having positive chargeability, such as a polyamide resin, which is preferably used with a negative toner.

In the system for coating the developer as a thin layer on the developer holding member 2 with the blade 5, it is desirable to decrease the thickness of the developer thin layer rather than the space between the developer holding member 2 and the opposite latent image holding member 1, and to apply an alternating electric field, in order to provide a sufficient image density. The alternating electric field or a developing bias superimposing a D.C. electric field upon the alternating electric field is applied between the developer holding member 2 and the latent image holding member 1 from a bias power source 6 shown in FIG. 1, so that the developer can be easily transferred from the developer holding member 2 to the latent image holding member 1 resulting in a high quality of image.

The process for producing a full-color image of the present invention will now be explained below.

In a color image forming method of the present invention, the color image is obtained by forming a color toner image on a recording material with at least one color toner selected from the group of cyan toner, magenta toner, and yellow toner, and by fixing with heat the formed color toner image on the recording material. The cyan toner, magenta toner, and yellow toner have the constitution of the color toner of the present invention.

The process for producing a color image will now be explained with a diagrammatic representation of a full-color image forming apparatus using a color image forming method of the present invention in FIG. 2.

Figure 2:
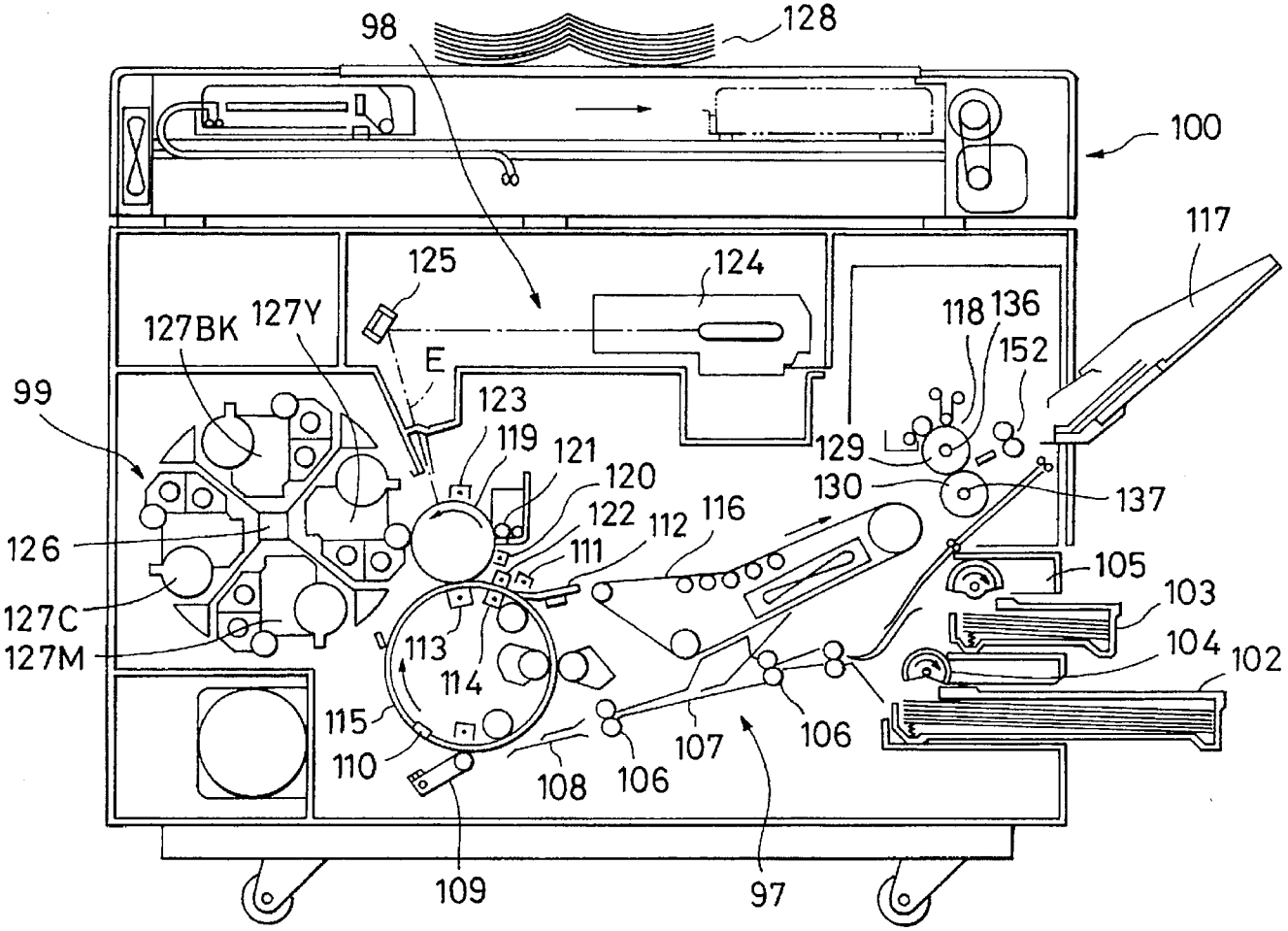
FIG. 2 is a diagrammatic representation of a full-color image forming apparatus using a color image forming method using a color toner of the present invention.

The color image forming apparatus shown in FIG. 2 mainly consists of a recording material carrying system 97, a latent image forming section 98, and a developing means 99, wherein the recording material carrying system 97 is placed from the right side of the apparatus 101, i.e. the right side of FIG. 2, to the near center of the apparatus; the latent image forming section 98 is placed in the near center of the apparatus, close to a transferring drum 115 being a member of the recording material carrying system 97; and the developing means 99 is placed close to the latent image forming section 98.

The recording material carrying system 97 has the following structure; an opening is formed on the right wall of the apparatus 101 (the right side of FIG. 2), detachable recording material feeding trays 102 and 103 are mounted in the opening such that each tray partially protrudes from the body of the apparatus. Feeding rollers 104 and 105 are placed almost directly above the feeding trays 102 and 103, and a paper feeding roller 106 and paper feeding guides 107 and 108 are provided so that the feeding rollers 104 and 105 work in cooperation with a transferring drum 115 which is placed at the left side and is rotatable in the direction as indicated by the arrow A. Adjacent the surface of transferring drum 115, a contacting roller 109, a gripper 110, a charging device 111 for separating the recording material, and a scraper 112 are placed in turn along the rotating direction of the drum.

A transferring charging device 113 and a recording material separating charging device 114 are placed inside the transferring drum 115. In the transferring drum 115, a transferring sheet, not shown in FIG. 2, made of a polymer such as polyvinylidene fluoride is stuck on the section in which the recording material winds around. A carrying belt means 116 is provided close to the scraper 112 on the upper right of the transferring drum 115. A fixation device 118 is placed at the terminal, i.e. the right end, of the recording material carrying direction in the carrying belt means 116 in order to fix with heat the color toner image on the recording material. A detachable exhausting tray 117 is mounted at the downstream position of the fixation device 118 such that the tray 117 protrudes from the body of the apparatus 101.

Next, the latent image forming section 98 will be explained. A photosensitive drum 119 such as organic photoconductor (OPC) photosensitive drum, which can rotate in the direction as indicated by the arrow and hold the latent image, is placed so that both outside surfaces of the photosensitive drum 119 and the transferring drum 115 connect each other. A erasing exposure means 120, a cleaning means 121, and the first charging device 123 are placed in turn along the rotating direction of the photosensitive drum 119, near the periphery of the upper side of the drum 119. Further, in order to form an electrostatic latent image on the photosensitive drum 119, an image exposure means 124 such as a laser beam scanner for forming an electrostatic latent image and an image exposure reflecting means 125 such as a mirror are placed.

The constitution of the above rotating developing device 99 is as follows. A rotating body 126, which can freely rotate, is provided at the place which is opposite the outer surface of the photosensitive drum 119. Four kinds of developing devices are mounted at the respective sites along the periphery of the rotating body 126 in order to visualize, i.e. develop the electrostatic latent image formed on the outer surface of the photosensitive drum 119. The four kinds of developing devices include an yellow developing device 127Y, a magenta developing device 127M, a cyan developing device 127C, and a black developing device 127BK.

An example of a sequence of the imaging process in the image forming apparatus will now be explained for the full-color mode. When the photosensitive drum 119 rotates in the direction as indicated by the arrow in FIG. 2, a photosensitive material on the photosensitive drum 119 is charged by the first charging device 123. In the apparatus shown in FIG. 2, the operation speed (described as the process speed below) of each section is more than 100 mm/sec (for example, 130 to 250 mm/sec). After the charging of the photosensitive drum 119 by the first charging device 123, images are exposed by the laser light E modified with yellow image signals from a manuscript 128. Electrostatic latent images are formed on the photosensitive drum 119 and developed with the yellow developing device 127Y preliminarily positioned to the developing station by means of the rotation of the rotating body, and images employing the yellow toner are formed.

The recording material carried through the paper feeding guide 107, the paper feeding roller 106, and the paper feeding guide 108 is held by the gripper 110 at a predetermined timing, then electrostatically wound around the transferring drum 115 by the contacting roller 109 and the electrode opposite to the contacting roller 109. The transferring drum 115 rotates in the direction as indicated by the arrow in synchronization with the photosensitive drum 119. The yellow toner images formed by the yellow developing device 127Y are transferred to the recording material by the transferring charging device 113 at the position in which the outer surface of the photosensitive drum 119 contacts the outer surface of the transferring drum 115. The transferring drum 115 continues to rotate to provide the next color transfer (magenta in FIG. 2).

The photosensitive drum 119 is discharged by the erasing exposure means 120, and cleaned up with the cleaning means 121 by a cleaning blade. Then the photosensitive drum 119 is re-charged with the first charging device 123 in order to form electrostatic latent images by means of the image exposure from magenta image signals. The rotating developing device rotates while the electrostatic latent images are formed on the photosensitive drum 119 such that the magenta developing device 127M is positioned at the above-predetermined developing station for developing by the magenta toner. The above process is repeated for the cyan and black colors. After transferring the four color toner images, the electrostatic four color images formed on the recording material are discharged by charging devices 122 and 114. Then the recording material is separated from the transferring drum 115 by scraper 112 while the recording material is released by gripper 110, and carried to fixation device 118 by carrying belt 116 in order to fix with heat and pressure. The sequence for full-color printing is completed this way, and the desired full-color printing image is formed on one side of the recording material.

Full-color image formation is carried out by using the four color toners, i.e. cyan toner, magenta toner, yellow toner, as well as black toner in the above embodiment. A full-color image formation using three color toners of cyan toner, magenta toner, and yellow toner can also be achieved by forming the black color from these three color toners. Further, monochrome color image formation using only one color toner among cyan toner, magenta toner, and yellow toner, and bi-color image formation using two color toners can also be carried out in the present invention. Moreover, a full-color image can be formed by using at least one color toner of cyan toner, magenta toner, and yellow toner, in combination with any commercial black toner.

The measuring methods employed in the present invention will now be explained below.

(1) Glass Transition Temperature (Tg) Measurement

A differential scanning calorimeter (DSC), DSC-7 (made by Perkin Elmer Co.) was used for the measurement of the glass transition temperature of the polymer resin. Approximately 5 to 20 mg, and preferably 10 mg, of accurately weighed sample was packed into an aluminum pan. The DSC measurement was carried out using an empty aluminum pan as the reference at the 10° C./min of heating rate in the temperature range from 30° to 200° C. An endothermogram having a main peak at a temperature ranging from 40° to 100° C. can be observed during the heating process. The glass transition temperature (Tg) is defined as the crossing point of the endothermogram and the middle line between two base lines before and after the endothermic peak in the present invention.

(2) Gloss Measurement

Each solid image used for the chromaticity measurement is used for the gloss measurement by using a VG-10 glossimeter (made by Nihon Denshoku K.K.). After the voltage was set to 6 V with a constant voltage generator, both the projection angle and the receiving angle were adjusted to 60°. After standard setting by zero point adjustment with a standard plate, the image sample was placed on the sample holder, three sheets of white paper were folded on the sample, and then the measurement was carried out. The displayed figure was read up to percent order.

(3) Softening Temperature Measurement of the Resin

Flow tester CFT-500 (made by Shimazu Seisakusho K.K.) was used for the softening temperature measurement of the resin. Approximately 1.0 g of sample, which had passed through the 60 mesh screen, was weighed, and pressed for one minute under the load of 100 kg/cm$^2$ by the pressing machine. The pressed sample was measured at atmospheric temperature and humidity (20° to 30° C., and 30 to 70 RH) under the conditions described below to obtain a temperature-apparent viscosity curve. The softening point (Tm) of the resin was determined from the obtained smooth curve by calculating the temperature at which 50 percent of the resin sample flowed out.

| | |
|---|---|
| Rate temperature | 6.0 D/M (°C./min.) |
| Set temperature | 50.0 Deg. (°C.) |
| Maximum temperature | 180.0 Deg. (°C.) |
| Interval | 3.0 Deg. (°C.) |
| Preheat | 300.0 Sec. (seconds) |
| Load | 20.0 (kg) |
| Die (Diameter) | 1.0 (mm) |
| Die (Length) | 1.0 (mm) |
| Plunger | 1.0 (cm$^2$) |

(4) Average Particle Size Measurement of the Pigment Particles in the Color Toner Particles A toner was added into 2.3M of a sugar solution. After stirring sufficiently, a small quantity of the solution was applied to a sample holder pin. Then, immediately after solidifying in liquid nitrogen, the solid was placed on the sample arm head. A sample for measurement was prepared by cutting with an ultra-microtome with a cryostat FC4E (made by Nissei Sangyo K.K.) in a conventional method. A transmission electron microscope photograph was taken with transmission electron microscope, model H-8000 (made by Hitachi Seisakusho K.K.) at 100 kV of accelerated voltage. Magnification was selected according to the sample.

The image information was input to a model Luzex 3 image analyzer made by (Nileco K.K.) through an interface to convert the binary image data. The pigment particles having a particle size of more than 0.1 μm were selected at random for the analysis. The measurements of the particle size were repeated until the measured number exceeds 300. Finally, the number average particle size (diameter) and particle size distribution of the pigment particles were calculated.

As described above, only particles having a particle size of more than 0.1 μm were counted in the measurement. The diameter of the particle is defined as the diameter of the sphere, in which each pigment particle image was converted to a sphere having the same volume as the original particle.

In the present invention, the color toner comprises color toner particles comprising a coloring agent and a non-linear polyester resin, said polyester resin formed by reacting (i) a linear polyester resin comprising condensed repeating units of a diol component and a dicarboxylic acid component and (ii) a tri- or higher carboxylic acid compound, said tri- or higher carboxylic acid compound represented by the following general formula (1) or an acid anhydride thereof:

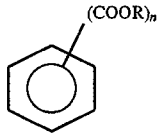

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, wherein the coloring agent is formed from pigment particles, the pigment particles in the color toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and the color toner has a softening temperature (Tm) of 85° C. to 120° C. calculated from a flow tester curve. Hence, it is possible to obtain excellent fixing property, color mixing, triboelectric chargeability and gloss characteristics, high image density, high color saturation, and high transparency.

EXAMPLES

The present invention will now be explained in detail based on the following illustrative examples.

Production of Polyester Resin –1

Into a two-liter, four-necked, glass flask equipped with thermometer, mechanical stirrer, reflux condenser, and nitrogen introducing pipe were poured 2 mol of terephthalic acid, 1.09 mol of dodecenyl succinic anhydride, 3.4 mol of polyoxypropylene-(2.2)-2,2-bis(4-hydroxyphenyl)propane, and 0.01 g of dibutyltin oxide. The flask was placed on a mantle heater. After the atmosphere in the flask was replaced with nitrogen gas, the mixture was gradually heated to 170° C. with stirring, and held there for five hours. Then the mixture was heated to 190° C. and held there for four hours. The thus-prepared resin has a hydroxyl value of 59.8.

Then, into the flask, 0.2 mol of trimellitic acid anhydride, and 0.08 g of dibutyltin oxide were added. The mixture was allowed to react at 190° C. for three hours, then heated to 200° C. and held there for five hours to obtain a Polyester Resin (1).

The resulting Polyester Resin (1) has a softening temperature (Tm) of 104° C. and a glass transition temperature (Tg) of 64° C.

Production of Polyester Resin –2

Into a two-liter, four-necked, glass flask equipped with thermometer, mechanical stirrer, reflux condenser, and nitrogen introducing pipe were poured 1.9 mol of isophthalic acid, 1.22 mol of octylsuccinic acid, and 3.34 mol of polyoxyethylene-(2.0)-2,2-bis(4-hydroxyphenyl)propane. The mixture was allowed to react in a similar way to Polyester Resin –1 in the nitrogen atmosphere. Then, after 0.13 mol of trimellitic acid anhydride, 0.09 g of dibutyltin oxide were added, the mixture was heated to 180° C. and held there for five hours to obtain Polyester Resin (2).

The resulting Polyester Resin (2) has a softening temperature (Tm) of 106° C. and a glass transition temperature (Tg) of 62° C.

Production of Polyester Resin –3

Into a two-liter, four-necked, glass flask equipped with thermometer, mechanical stirrer, reflux condenser, and nitrogen introducing pipe were poured 3 mol of terephthalic acid, 1.6 mol of polyoxypropylene-(2.2)-2,2-bis(4-hydroxyphenyl)propane, 1.6 mol of polyoxyethylene-(2.0)-2,2-bis(4-hydroxyphenyl)propane, and 0.01 g of dibutyltin oxide. The mixture was allowed to react in a similar way to Polyester Resin –1 in the nitrogen atmosphere. Then, after 0.3 mol of tri-n-butyl 1,2,4-benzenetricarboxylate was added, the mixture was heated to 220° C. and held there for five hours to obtain Polyester Resin (3).

The resulting Polyester Resin (3) has a softening temperature (Tm) of 101° C. and a glass transition temperature (Tg) of 60° C.

Production of Polyester Resin –4

Using the same equipment as Polyester Resin –1, a mixture of 2.0 mol of polyoxypropylene-(2.2)-2,2-bis(4-hydroxyphenyl)propane, 2.1 mol of polyoxyethylene-(2.2)-2,2-bis(4-hydroxyphenyl)propane, 2 mol of terephthalic acid, 1.6 mol of dodecenyl succinic anhydride, and 0.46 mol of trimellitic acid was allowed to react at 250° C. for eight hours in order to obtain Polyester Resin (4).

The resulting Polyester Resin (4) has a softening temperature (Tm) of 118° C. and a glass transition temperature (Tg) of 61.5° C.

Production of Polyester Resin –5

In a similar method to Polyester Resin –1, Polyester Resin (5) was obtained from a mixture of 2 mol of isophthalic acid, 1.4 mol of fumaric acid, 1.5 mol of polyoxypropylene-(2.2)-2,2-bis(4-hydroxyphenyl)propane, 1.5 mol of polyoxyethylene-(2.0)-2,2-bis(4-hydroxyphenyl)propane, and 0.02 g of dibutyltin oxide in a two-liter, four-necked, glass flask.

The resulting Polyester Resin (5) has a softening temperature (Tm) of 82° C. and a glass transition temperature (Tg) of 51° C.

Production of Polyester Resin –6

In a similar method to Polyester Resin –1, Polyester Resin (6) was obtained from a mixture of 1.4 mol of fumaric acid, 1.4 mol of polyoxypropylene-(2.2)-2,2-bis(4-hydroxyphenyl)propane, and 0.02 g of dibutyltin oxide.

The resulting Polyester Resin (6) has a softening temperature (Tm) of 92° C. and a glass transition temperature (Tg) of 58° C.

Production of Polyester Resin –7

In a similar method to Polyester Resin –1, except that 0.3 mol of 1,2,5-hexanetricarboxylic acid was used instead of 0.2 mol of trimellitic acid anhydride, Polyester Resin (7) was obtained.

The resulting Polyester Resin (7) has a softening temperature (Tm) of 102° C. and a glass transition temperature (Tg) of 58° C.

The results for the glass transition temperature (Tg) and softening temperature (Tm) of Polyester Resins (1) to (7) are summarized in Table 1.

TABLE 1

Physical Properties of Polyester Resins

| Polyester resin No. | Tg (°C.) | Tm (°C.) |
|---|---|---|
| (1) | 64 | 104 |
| (2) | 62 | 106 |
| (3) | 60 | 101 |
| (4) | 61.5 | 118 |
| (5) | 51 | 82 |
| (6) | 58 | 92 |
| (7) | 58 | 102 |

Example 1

The First Kneading Step

As raw materials, 70 parts by weight of Polyester Resin (1) and 100 parts by weight of a paste pigment were prepared, in which the paste pigment was obtained by preparing a pigment slurry of C.I. Pigment Blue 15:3 by any known method, removing water to some extent before filtration and through no drying process. The paste pigment contains 30 weight percent of a solid body and the balance water.

The above raw materials were fed into a kneader type mixture, and the raw material were mixed and heated to the maximum temperature with stirring at a pressurized atmosphere. The maximum temperature is naturally determined by the boiling point of the solvent used in the paste, and is 90° to 100° C. in this case. At the time that the mixture reaches the maximum temperature, the pigment in the aqueous phase is distributed into or migrates into the resin melt phase. After confirming this, further melt-kneading was continued for 30 minutes in order to complete the migration of the pigment in the paste into the resin phase. The mixing was suspended, then after removing hot water, the kneading type mixture was heated to 130° C. and melt-kneaded for 30 minutes so as to disperse the pigment particles and remove water. Finally, the cooled kneaded product was taken out from the kneader type mixture. The final kneaded product has a water absorption state of approximately 0.5 weight percent.

| The second kneading step | |
|---|---|
| The above mixed product (Pigment particle content: 30 weight percent) | 16.7 parts by weight |
| Polyester Resin (1) | 88.3 parts by weight |
| Chromium complex of di-tert-butylsalicylic acid | 4 parts by weight |

After the mixture of the above recipe was pre-mixed with a Henschel mixer, the mixture was melt-kneaded using a biaxial extruder set at 120° C. After cooling, the obtained kneaded product was roughly crushed into approximately 1 to 2 mm with a hammer mill, then finely pulverized into particle size of less than 40 μm using an air jet grinder. Classified cyan toner particles were obtained by classification of the pulverized powder so that the volume average diameter of the separated particles is 8.2 μm. A cyan toner (A) was prepared by adding 1.0 parts by weight of fine titanium oxide powder, which was hydrophobically treated with an isobutyltrimethoxysilane as a silicone compound of 20 percent by weight based on the titanium oxide in order to improve the flowability and to provide triboelectric charge, to 100 parts by weight of the cyan toner particles.

A two-component type developer was prepared by mixing 5.0 parts by weight of the cyan toner (A) and a Cu-Zn-Fe ferrite carrier coated with approximately 0.35 weight percent of styrene-methyl methacrylate (monomer weight ratio in the copolymer 65:35) so that the total quantity is 100 parts by weight. Thus, the toner concentration in the two-component type developer is 5.0 weight percent.

Copying tests of the two-component type developer were carried out using a commercial plain paper color copying machine (Color Laser Copier 550) shown in FIG. 2. The fixing roller used has a diameter of 60 mm and comprises an aluminum core sleeve of 5 mm in thickness, an inner silicone rubber layer (room temperature vulcanizing type) of 2 mm in thickness thereon, a middle fluorocarbon rubber layer of 50 μm in thickness thereon, and an outer silicone rubber (high temperature vulcanizing type) of 230 μm in thickness thereon. The pressure roller used comprises an aluminum core sleeve of 5 mm in thickness, an inner silicone rubber layer (room temperature vulcanizing type) of 2 mm in thickness thereon, a middle fluorocarbon rubber layer of 50 μm in thickness thereon, and an outer silicone rubber (high temperature vulcanizing type) of 200 μm in thickness thereon.

The initial image obtained in the copying tests shows excellent color saturation and bright tonality. Further, after 60,000 times of repeated operation, the obtained image shows excellent color reproducibility in which the cyan image exactly reproduces its original color. The transferring of the paper and detection of the concentration of the developer work well so stable density of image is obtained. Even at a fixing temperature of 160° C. and repeated copying operation of 60,000 times, no offset to the fixing roller was observed. The offset was evaluated by visual observation of the fixing roller surface after the repeated copying.

In order to comparatively evaluate high temperature offset, a new fixing roller of the fixing device was employed. While stopping the drive of the web impregnating silicone oil, 5,000 times of repeated copying were carried out using an original image having an area ratio of 20%. After this, the quantity of the toner attached to the web, i.e. the high temperature offset, was determined using a Macbeth reflectance densitometer. The obtained density value was 0.3 and is extremely low. In this method, the greater the high temperature offset the higher reading of the reflectance densitometer on the web with toner.

The electrification was determined at low-temperature/low-humidity (15° C./10% RH) and high-temperature/high-humidity (32.5° C./85% RH). The ratio of the electrification was 1.35 which shows much less dependency on environmental conditions.

Gloss value measurement of the image surface is one of the evaluation methods of the color image. A higher gloss value is regarded as a higher color quality of smooth image surface and high color saturation having luster, while a lower gloss value is regarded as subdued, rough image surface. In Example 1, the image density was 1.68 (Macbeth reflectance density) at 300 V of contrast potential), and the gloss value was 21%. The transparency was also excellent, when the color image formed on a transparent sheet was projected to an over-head projector (OHP).

The offset to the fixing roller, color reproducibility, and the transparency of the image on the OHP sheet were evaluated as follows:

The extent of the offset was evaluated by visual observation of the fixing roller surface after repeated copying.

The color reproducibility was evaluated based on the following standard after calculating a color difference (ΔE)

between the original image and copied image by the following equation;

$$\Delta E=\{(L_1^*-L_2^*)+(a_1^*-a_2^*)^2+(b_1^*-b_2^*)^2\}^{1/2}$$

where $L_1^*$ represents the lightness on the original image, and $a_1^*$ and $b_1^*$ represent the chromaticity indicating the hue and the chromaticness on the original image, and $L_2^*$ represents the lightness on the original image, and $a_2^*$ and $b_2^*$ represent the chromaticity indicating the hue and the chromaticness on the copied image.

(Evaluation Standard)

Excellent: Excellent color reproducibility and color saturation, $\Delta E \leqq 5$ Good: Somewhat less brightness but practically no problem, $5 \leqq \Delta E \leqq 10$ No Good: No brightness and poor color reproducibility of secondary color, $\Delta E \geqq 10$ The transparency of the image on the OHP sheet was evaluated based on the following standard by projecting the color image formed on the transparency sheet using a commercial overhead projector:

(Evaluation Standard)

Excellent: Excellent transparency and color reproducibility without irregular brilliancy Good: Somewhat irregular brilliancy but practically no problem No Good: Irregular brilliancy and poor color reproducibility Example 2

A magenta toner (B) was prepared in a similar method to Example 1, but by changing the recipe as follows:

The First Kneading Step

Polyester Resin (2): 58.3 parts by weight Water paste pigment containing 25 weight percent of C.I. Pigment Red 122: 100 parts by weight The Second Kneading Step The kneaded product obtained from the first kneading step (the pigment particle content: 30 weight percent): 16.7 parts by weight Polyester Resin (2): 88.3 parts by weight Chromium complex 4 parts by weight Using the prepared magenta toner (B), a durability test was carried out by repeated copying. After 30,000 copies, no offset to the roller was observed and the transparency of the image projected by the OHP was excellent. The maximum image density ($D_{max}$) was 1.74.

Example 3

A yellow toner (C) was prepared in a similar method to Example 1, but by changing the recipe as follows:

The First Kneading Step

Polyester Resin (3): 80 parts by weight Water paste pigment containing 20 weight percent of C.I. Pigment Yellow 17: 100 parts by weight The Second Kneading Step The kneaded product obtained from the first kneading step (the pigment particle content: 20 weight percent): 17.5 parts by weight Polyester Resin (3): 86 parts by weight Chromium complex 4 parts by weight Using the prepared magenta toner (C), a durability test was carried out by repeated copying. After 30,000 copies, no offset to the roller was observed and the transparency of the image projected by the OHP was excellent.

Example 4

A full-color image was obtained by using three colors of the cyan toner (A) of Example 1, magenta toner (B) of Example 2, and yellow toner (C) of Example 3.

An excellent image, which can exactly reproduce the original image, is obtained from these toners. In durability test, the offset to the fixing roller was not observed with high quality of image up to 10,000 times of repeated copying. Full-color images having excellent gradation were obtainable for a long-term. The transparency of the image projected by the OHP was also excellent. The color reproducibility at each portion of green, blue, and red was excellent.

Example 5

A black toner (X) was prepared in a similar method to Example 1, but by changing the recipe as follows:

The First Kneading Step

Polyester Resin (1): 70 parts by weight Water paste pigment containing 26 weight percent of carbon black having primary particles size of 60 mm: 100 parts by weight The Second Kneading Step The kneaded product obtained from the first kneading step (the carbon black content: 30 weight percent): 16.67 parts by weight Polyester Resin (1): 87.83 parts by weight A full-color image was obtained by using four colors of the black toner (X), the cyan toner (A) of Example 1, magenta toner (B) of Example 2, and yellow toner (C) of Example 3.

An excellent image, which can exactly reproduce the original image, was obtained from these toners. In durability test, the offset to the fixing roller was not observed with high quality of image up to 20,000 times of repeated copying. Full-color images having excellent gradation was obtainable for a long-term. The transparency of the image projected by the OHP was also excellent.

Example 6

A cyan toner (G) was prepared by the following recipe:

The First Kneading Step

Polyester Resin (1): 100 parts by weight A 15:3 dry powder mixture of copper phthalocyanine pigments and C.I. Pigment Blue: 30 parts by weight After the above materials were sufficiently premixed with a Hencschel mixer, the premixed sample was mixed with melt six times using a three roll mill. The mixture was taken out after cooling.

The Second Kneading Step

The kneaded product obtained from the first kneading step (the pigment particle content: 30 weight percent): 16.7 parts by weight Polyester Resin (1): 88.3 parts by weight Chromium complex (charge controller): 4 parts by weight.

A cyan toner (G) obtained by a similar method to Example 1 has a volume average diameter of 8.1 μm.

Results of the durability tests by repeated copying using the cyan toner (G) like Example 1 demonstrated that no offset was observed. However, in the reproducing test of a green image using two colors of the cyan toner (G) and the yellow toner (c) of Example 3, the green color saturation just reaches a practical level, although the level is lower than that of Example 4.

Example 7

A cyan toner (Y) was prepared in a similar method to Example 1 except that the chromium complex used in the second kneading step of Example 1 was not used and the melt-kneading in the second kneading step was carried out by setting the temperature of the biaxial extruder to 100° C.

In durability tests, although the offset to the fixing roller was not observed up to 10,000 times of repeated copying, the amount of fog increased during the durability operation and a only dry, rough image was obtainable. In the green color reproducing test by combined using of the cyan toner (Y) with the yellow toner (C) of Example 3, the green color saturation decreased compared with that of Example 4. However, the toner satisfies all practical levels.

Comparative Example 1

A cyan toner (D) was prepared in a similar method to Example 1 except that Polyester Resin (4) was used instead of Polyester Resin (1) in the first and second kneading step.

In durability tests of the obtained cyan toner (D) after repeated copying, although the offset to the fixing roller was not observed up to 10,000 times of repeated copying, the transparency of the transparent sheet image did not reach the practical level from the initial repeated operation.

Comparative Example 2

A cyan toner (E) was prepared in a similar method to Example 1 except that Polyester Resin (5) was used instead of Polyester Resin (1) in the first and second kneading step.

In durability tests of the obtained cyan toner (E) by the repeated copying, offset to the fixing roller occurred on an impractically high level from the initial repeated operation.

Comparative Example 3

Polyester Resin (1): 100 parts by weight A 15:3 dry powder mixture of copper phthalocyanine pigments and C.I. Pigment Blue: 5 parts by weight Chromium complex (charge controller) 4 parts by weight After the above materials were sufficiently premixed with a Hencschel mixer, the premixed sample was melt-kneaded using a biaxial extruder at 120° C. A cyan toner (F) having a volume average diameter of 8.0 μm was prepared in a similar method to Example 1.

In durability tests of the obtained cyan toner (F) by the repeated copying, a considerably fogged image was obtained with toner scattering from the initial repeated operation. Some offset on the roller surface also was observed after 10,000 times of repeated operation.

In the green color reproducibility test by the combined use of the cyan toner (F) with the yellow toner (C) of the Example 3, the color saturation significantly decreased compared with that of Example 4, demonstrating that the color cyan toner (F) caused unsatisfactory color reproducibility.

Comparative Example 4

A cyan toner (H) was prepared in a similar method to Example 1 except that Polyester Resin (6) was used instead of Polyester Resin (1) in the first and second kneading step.

The durability test of the obtained cyan toner (H) after repeated copying was broken off after 10,000 copies because offset to the fixing roller occurred.

Comparative Example 5

A cyan toner (I) was prepared in a similar method to Example 1 except that Polyester Resin (7) was used instead of Polyester Resin (1) in the first and second kneading step.

The results of durability test of the obtained cyan toner (I) after repeated copying demonstrated that although the offset resistance was excellent, the transparency of the transparent sheet image was poor from the initial operation and the color saturation was somewhat low.

Comparative Example 6

A cyan toner (J) was prepared in method similar to Example 1 except that the kneading times was changed from 6 times to twice in the first kneading step.

The results of durability test of the obtained cyan toner (J) after repeated copying demonstrated that the transparency of the transparent sheet image was poor from the initial operation. The green color saturation of the reproducibility test by the combined use of the cyan toner (J) with the yellow toner (C) was extremely lower than that of Example 6 and was at an impractically low level.

Comparative Example 7

A cyan toner (K) was prepared by a similar method to Example 1 except that Polyester Resin (6) was used instead of Polyester Resin (1) in the first and second kneading steps and the kneading times was changed from 6 times to twice in the first kneading step.

The durability test of the obtained cyan toner (K) by repeated copying was broken off at 5,000 copies due to offset on the roller surface.

Comparative Example 8

A cyan toner (L) was prepared in a similar method to Example 1 except that the kneading with heat of Polyester Resin with the paste pigment was carried out at 120° C. under a pressurized atmosphere in the first kneading step.

The results of the durability test of the obtained cyan toner (L) by repeated copying demonstrated that some offset on the fixing roller surface was observed after 10,000 copies. Because the softening temperature of the toner (L) decreased to 101° C., it is considered that this phenomenon is caused by the polymer chain scission during kneading with heat under a pressurized atmosphere.

Comparative Example 9

A cyan toner (M) was prepared by a similar method to Example 1 except that Polyester Resin (6) was used instead of Polyester Resin (1) in the first and second kneading step, and the kneading with heat of Polyester Resin with the paste pigment was carried out at 120° C. under a pressurized atmosphere in the first kneading step.

The results of the durability test of the obtained cyan toner (M) by repeated copying show that a significantly fogged image was obtained from the initial operation with toner scattering, and some offset on the fixing roller surface was also observed after 5,000 copies.

Comparative Example 10

A cyan toner (N) was prepared in a similar method to Example 1 except that the chromium complex of di-tert-butylsalicylic acid was not used in the second kneading step.

The results of the durability test of the obtained cyan toner (N) after repeated copying show that significantly fogged image was obtained from the initial operation with toner scattering, and the transparency of the transparent sheet image decreased compared with that of Example 1.

Table 2 shows the summarized results of the physical properties of toners (A) to (N), (X), and (Y) used in the above Examples 1 to 7 and Comparative Examples 1 to 10, and Table 3 shows the results of the toner evaluation obtained from the above Examples 1 to 7, and Comparative Example 1 to 10.

TABLE 2

Physical Properties of Toners

| Toners | Polyester Resin | Toner Tm (°C.) | Particle Size of Pigment Particles in Toner Particles: Number Average | 0.1–0.5 μm | ≧0.8 μm |
|---|---|---|---|---|---|
| Cyan toner (A) | Resin (1) | 107° C. | 0.35 μm | 82.0% | 0.9% |
| Magenta toner (B) | Resin (1) + Resin (2) | 108° C. | 0.41 μm | 71.9% | 1.3% |
| Yellow toner (C) | Resin (3) | 102° C. | 0.32 μm | 87.2% | 1.1% |
| Cyan toner (D) | Resin (4) | 121° C. | 0.69 μm | 32.5% | 33.8% |
| Cyan toner (E) | Resin (5) | 84° C. | 0.33 μm | 78.4% | 0% |
| Cyan toner (F) | Resin (1) | 104° C. | 0.75 μm | 19.7% | 44.6% |
| Cyan toner (G) | Resin (1) | 106° C. | 0.54 μm | 60.3% | 9.6% |
| Cyan toner (H) | Resin (6) | 91° C. | 0.42 μm | 57% | 7.4% |
| Cyan toner (I) | Resin (7) | 102° C. | 0.57 μm | 32% | 13% |
| Cyan toner (J) | Resin (1) | 105° C. | 0.62 μm | 30.1% | 11% |
| Cyan toner (K) | Resin (6) | 90° C. | 0.72 μm | 15.0% | 43% |
| Cyan toner (L) | Resin (1) | 101° C. | 0.62 μm | 42% | 19% |
| Cyan toner (M) | Resin (6) | 91° C. | 0.78 μm | 23.1% | 54.2% |
| Cyan toner (N) | Resin (1) | 104° C. | 0.41 μm | 61.3% | 12% |
| Black toner (X) | Resin (1) | 108° C. | 0.21 μm | 89% | 0.2% |
| Cyan toner (Y) | Resin (1) | 106° C. | 0.42 μm | 65% | 3.3% |

TABLE 3

Durability Test Results

| | Toners | Repeated Number | Offset to fixing roller | Contamination of fixing web | Color Reproducibility | Gloss | Transparency of transparent sheet |
|---|---|---|---|---|---|---|---|
| Ex. 1 | (A) | 60000 | None | 0.3 | Excellent | 21% | Excellent |
| Ex. 2 | (B) | 30000 | None | 0.3 | Excellent | 18% | Excellent |
| Ex. 3 | (C) | 30000 | None | 0.3 | Excellent | 23% | Excellent |
| Ex. 4 | (A),(B),(C) | 10000 | None | 0.5 (for three toners) | Excellent | — | Excellent |
| Ex. 5 | (A),(B),(C),(X) | 20000 | None | 0.4 (for four toners) | Excellent | — | Excellent |
| Ex. 6 | (G) | 10000 | None | 0.3 | Good | 20% | Good |
| Ex. 7 | (Y) | 10000 | None | 0.3 | Good | 23% | Good |
| Comp. Ex. 1 | (D) | 10000 | None | 0.2 | N.G. | 6% | N.G. |

TABLE 3-continued

Durability Test Results

| | Toners | Repeated Number | Offset to fixing roller | Contamination of fixing web | Color Reproducibility | Gloss | Transparency of transparent sheet |
|---|---|---|---|---|---|---|---|
| Comp. Ex. 2 | (E) | Initial | Severe | — | — | — | — |
| Comp. Ex. 3 | (F) | 10000 | Slight | 0.4 | N.G. | 22% | N.G. |
| Comp. Ex. 4 | (H) | 10000 | Extremely severe | 0.7 | Excellent | 26% | Excellent |
| Comp. Ex. 5 | (I) | 10000 | None | 0.3 | Good | 22% | N.G. |
| Comp. Ex. 6 | (J) | — | — | — | N.G. | 21% | N.G. |
| Comp. Ex. 7 | (K) | 5000 | Extremely severe | 0.7 | N.G. | 23% | N.G. |
| Comp. Ex. 8 | (L) | 10000 | Slight | 0.4 | Good | 27% | Good |
| Comp. Ex. 9 | (M) | 5000 | Slight | 0.5 | N.G. | 30% | N.G. |
| Comp. Ex. 10 | (N) | 20000 | Slight | 0.4 | Good | 23% | N.G. |

Ex.: Example Comp. Ex.:Comparative Example N.G. = no good

Example 8

By using the cyan toner (A) in a similar method to Example 1 except that the developing device was changed to the device using a non magnetic one-component type developer as shown in FIG. 1, repeated copying was carried out 5,000 times. No toner sticking to developing sleeve 2, blade 5, and feeding roller 4 was observed. A high $D_{max}$ value, i.e. 1.7 of image density was obtained at 300 V of potential contrast. The problem of fog and toner scattering in the device due to the decreased electrification of the toner did not occur. No offset to the fixing roller was observed during the test.

The evaluation results are shown in Table 4.

Example 9

A durability test was carried out by repeated copying in a method similar to Example 8 except for the use of the magenta toner (B) of Example 2 instead of the cyan toner (A). The results are shown in Table 4.

Example 10

A durability test was carried out by repeated copying in a method similar to Example 8 except for the use of the yellow toner (C) of Example 3 instead of the cyan toner (A). The results are shown in Table 4.

Example 11

A durability test was carried out by repeated copying in a method similar to Example 8 except for the use of the cyan toner (G) of example 6 instead of the cyan toner (A). The results are shown in Table 4.

Example 12

A durability test was carried out by repeated copying in a method similar to Example 8 except for the use of the cyan toner (Y) of Example 7 instead of the cyan toner (A). The results are shown in Table 4.

Comparative Example 11

A durability test was carried out by repeated copying in a method similar to Example 8 except for the use of the cyan toner (D) of Comparative Example 1 instead of the cyan toner (A). The results are shown in Table 4.

Comparative Example 12

A durability test was carried out by repeated copying in a method similar to Example 8 except for the use of the cyan toner (E) of Comparative Example 2 instead of the cyan toner (A). The results are shown in Table 4.

Comparative Example 13

A durability test was carried out by repeated copying in a method similar to Example 8 except for the use of the cyan toner (F) of Comparative Example 3 instead of the cyan toner (A). The results are shown in Table 4.

Comparative Example 14

A durability test was carried out by repeated copying in a method similar to Example 8 except for the use of the cyan toner (H) of Comparative Example 4 instead of the cyan toner (A). The results are shown in Table 4.

Comparative Example 15

A durability test was carried out by repeated copying in a method similar to Example 8 except for the use of the cyan toner (I) of Comparative Example 5 instead of the cyan toner (A). The results are shown in Table 4.

Comparative Example 16

A durability test was carried out by repeated copying in a method similar to Example 8 except for the use of the cyan toner (J) of Comparative Example 6 instead of the cyan toner (A). The results are shown in Table 4.

Comparative Example 17

A durability test was carried out by repeated copying in a method similar to Example 8 except for the use of the cyan toner (K) of Comparative Example 7 instead of the cyan toner (A). The results are shown in Table 4.

Comparative Example 18

A durability test was carried out by repeated copying in a method similar to Example 8 except for the use of the cyan toner (L) of Comparative Example 8 instead of the cyan toner (A). The results are shown in Table 4.

Comparative Example 19

A durability test was carried out by repeated copying in a method similar to Example 8 except for the use of the cyan toner (M) of Comparative Example 9 instead of the cyan toner (A). The results are shown in Table 4.

Comparative Example 20

A durability test was carried out by repeated copying in a method similar to Example 8 except for the use of the cyan toner (N) of Comparative Example 10 instead of the cyan toner (A). The results are shown in Table 4.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

TABLE 4

Durability Test Results

| | Toners | Repeated Number | Offset to fixing roller | Contamination of fixing web | Color Reproducibility | Gloss | Transparency of transparent sheet |
|---|---|---|---|---|---|---|---|
| Ex. 8 | (A) | 5000 | None | 0.2 | Excellent | 20% | Excellent |
| Ex. 9 | (B) | 5000 | None | 0.2 | Excellent | 19% | Excellent |
| Ex. 10 | (C) | 5000 | None | 0.2 | Excellent | 22% | Excellent |
| Ex. 11 | (G) | 5000 | None | 0.2 | Good | 20% | Good |
| Ex. 12 | (Y) | 5000 | None | 0.2 | Good | 21% | Good |
| Comp. Ex. 11 | (D) | 5000 | None | ≦0.1 | N.G. | 1.6% | N.G. |
| Comp. Ex. 12 | (E) | 5000 | Fairly | 0.9 | Excellent | 37% | Excellent |
| Comp. Ex. 13 | (F) | 5000 | Slight | 0.3 | N.G. | 21% | N.G. |
| Comp. Ex. 14 | (H) | 5000 | Fairly | 0.5 | Good | 25% | Good |
| Comp. Ex. 15 | (I) | 5000 | Slight | 0.3 | Good | 3% | N.G. |
| Comp. Ex. 16 | (J) | — | — | — | N.G. | 22% | N.G. |
| Comp. Ex. 17 | (K) | 5000 | Fairly | 0.7 | N.G. | 22% | N.G. |
| Comp. Ex. 18 | (L) | 5000 | Slight | 0.4 | Good | 26% | Good |
| Comp. Ex. 19 | (M) | 5000 | Fairly | 0.6 | N.G. | 27% | N.G. |
| Comp. Ex. 20 | (N) | 5000 | Slight | 0.3 | Good | 24% | N.G. |

Ex.: Example Comp. Ex.:Comparative Example N.G. = no good

What is claimed:

1. A color toner comprising:

color toner particles containing a coloring agent and a non-linear polyester resin, said non-linear polyester resin synthesized from at least a tri- or higher carboxylic acid compound represented by the following general formula (1) or an acid anhydride thereof:

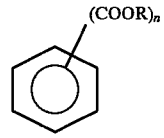

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, wherein said coloring agent is formed from pigment particles, said pigment particles in said color toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said color toner has a softening temperature of 85° C. to 120° C. calculated from a flow tester curve.

2. The color toner according to claim 1, wherein said non-linear polyester resin is formed by reacting (i) a linear polyester resin comprising condensed repeating units of a diol component and a dicarboxylic acid component and (ii) said tri- or higher carboxylic acid compound represented by the general formula (1) or the acid anhydride thereof.

3. The color toner according to claim 1, wherein said pigment particles in said color toner particles contain 65 percent by number of the pigment particles having a diameter of 0.1 to 0.5 μm.

4. The color toner according to claim 1, wherein said color toner particles contain an organic metal compound.

5. The color toner according to claim 1, wherein said organic metal compound includes an organic metal complex.

6. The color toner according to claim 1, wherein said color toner has a softening temperature of 90° C. to 115 ° C.

7. The color toner according to claim 1, wherein said pigment particles comprise a chromatic color pigment.

8. The color toner according to claim 7, wherein said chromatic color pigment is magenta pigment.

9. The color toner according to claim 7, wherein said chromatic color pigment is cyan pigment.

10. The color toner according to claim 7, wherein said chromatic color pigment is yellow pigment.

11. The color toner according to claim 1, wherein said pigment particles comprise a black pigment.

12. The color toner according to claim 1, wherein said pigment particles comprise a white pigment.

13. The color toner according to claim 8, wherein said toner particles contain said cyan pigment in amounts of no greater than parts by weight based on 100 parts by weight of a binder resin comprising said non-linear polyester resin.

14. The color toner according to claim 8, wherein said toner particles contain said cyan pigment in amounts of 0.1 to 9 parts by weight based on 100 parts by weight of a binder resin comprising said non-linear polyester resin.

15. The color toner according to claim 8, wherein said toner particles contain said magenta pigment in amounts of no greater than 15 parts by weight based on 100 parts by weight of a binder resin comprising said non-linear polyester resin.

16. The color toner according to claim 8, wherein said toner particles contain said magenta pigment in amounts of 0.1 to 9 parts by weight based on 100 parts by weight of a binder resin containing said non-linear polyester resin.

17. The color toner according to claim 10, wherein said toner particles contain said yellow pigment in amounts of no greater than 12 parts by weight based on 100 parts by weight of a binder resin containing said non-linear polyester resin.

18. The color toner according to claim 10, wherein said toner particles contain said yellow pigment in amounts of 0.5 to 7 parts by weight based on 100 parts by weight of a binder resin containing said non-linear polyester resin.

19. The color toner according to claim 1, wherein said compound represented by the general formula (1) or the acid anhydride thereof comprises a compound represented by the following general formula (4):

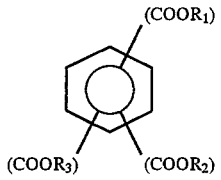

(4)

wherein R is a hydrogen atom, an alkyl group having 1 to 18 carbon atoms, an alkenyt group having 2 to 18 carbon atoms, or an aryl group having 6 to 18 carbon atoms.

20. The color toner according to claim 1, wherein said compound represented by the general formula (1) or the acid anhydride thereof comprises a compound represented by the following general formula (5):

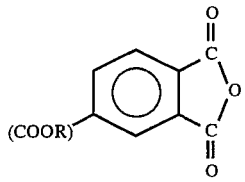

(5)

wherein R is a hydrogen atom, an alkyl group having 1 to 18 carbon atoms, an alkenyl group having 2 to 18 carbon atoms, or an aryl group having 6 to 18 carbon atoms.

21. The color toner according to claim 1, wherein said compound represented by the general formula (1) or the acid anhydride thereof comprises a compound represented by the general formula (6):

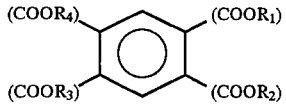

(6)

wherein $R_1$, $R_2$, $R_3$ and $R_4$ are the same or different and are each a hydrogen atom, an alkyl group having 1 to 18 carbon atoms, an alkenyl group having 2 to 18 carbon atoms, or an aryl group having 6 to 18 carbon atoms.

22. The color toner according to claim 1, wherein said compound represented by the general formula (1) or the acid anhydride thereof comprises a compound represented by the following general formula (7):

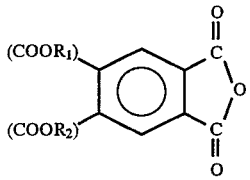

(7)

wherein $R_1$ and $R_2$ are the same or different and are each a hydrogen atom, an alkyl group having 1 to 18 carbon atoms, an alkenyl group having 2 to 18 carbon atoms, or an aryl group having 6 to 18 carbon atoms.

23. The color toner according to claim 1, wherein said compound represented by the general formula (1) or the acid anhydride thereof comprises a compound represented by the following general formula (8):

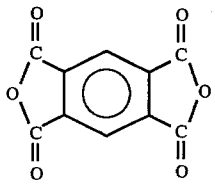

(8)

24. The color toner according to claim 1, wherein said color toner particles contain a charge controlling agent.

25. The color toner according to claim 1, wherein said color toner comprises a mixture of said color toner particles and an additive.

26. The color toner according to claim 25, wherein said additive includes a flowability improver.

27. The color toner according to claim 26, wherein said flowability improver comprises at least one material selected from a group consisting of a fluorocarbon resin powder, a metal salt of fatty acid, a metal oxide, a hydrophobically-treated metal oxide powder, a silica fine powder, and a surface-treated silica fine powder.

28. A two-component type developer comprising:

a color toner comprising color toner particles and a carrier, wherein said color toner particles comprise a coloring agent and a non-linear polyester resin synthesized from at least a tri- or higher carboxylic acid compound represented by the following general formula (1) or an acid anhydride thereof:

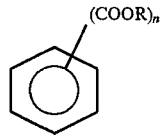

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, said coloring agent is formed from pigment particles, said pigment particles in said color toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said color toner has a softening temperature of 85° C. to 120° C. calculated from a flow tester curve.

29. The two-component type developer according to claim 28, wherein said non-linear polyester resin is formed by reacting (i) a linear polyester resin comprising condensed repeating units of a diol component and a dicarboxylic acid component and (ii) said tri- or higher carboxylic acid compound represented by the general formula (1) or the acid anhydride thereof.

30. The two-component type developer according to claim 28, wherein said pigment particles in said color toner particles contain 65 percent by number of the pigment particles having a diameter of 0.1 to 0.5 μm.

31. The two-component type developer according to claim 28, wherein said toner particles contain an organic metal compound.

32. The two-component type developer according to claim 28, wherein said organic metal compound includes an organic metal complex.

33. The two-component type developer according to claim 28, wherein said color toner has a softening temperature of 90° C. to 115° C.

34. The two-component type developer according to claim 28, wherein said pigment particles comprises a chromatic color pigment.

35. The two-component type developer according to claim 34, wherein said chromatic color pigment is magenta pigment.

36. The two-component type developer according to claim 34, wherein said chromatic color pigment is cyan pigment.

37. The two-component type developer according to claim 34, wherein said chromatic color pigment is yellow pigment.

38. The two-component type developer according to claim 28, wherein said pigment particles comprises a black pigment.

39. The two-component type developer according to claim 28, wherein said pigment particles comprises a white pigment.

40. The two-component type developer according to claim 35, wherein said toner particles contain said cyan pigment in amounts of no greater than 15 parts by weight based on 100 parts by weight of a binder resin containing said non-linear polyester resin.

41. The two-component type developer according to claim 35, wherein said toner particles contain said cyan pigment in amounts of 0.1 to 9 parts by weight based on 100 parts by weight of a binder resin containing said non-linear polyester resin.

42. The two-component type developer according to claim 35, wherein said toner particles contain said magenta pigment in amounts of no greater than 15 parts by weight based on 100 parts by weight of a binder resin containing said non-linear polyester resin.

43. The two-component type developer according to claim 35, wherein said toner particles contain said magenta pigment in amounts of 0.1 to 9 parts by weight based on 100 parts by weight of a binder resin containing said non-linear polyester resin.

44. The two-component type developer according to claim 37, wherein said toner particles contain said yellow pigment in amounts of no greater than 12 parts by weight based on 100 parts by weight of a binder resin containing said non-linear polyester resin.

45. The two-component type developer according to claim 37, wherein said toner particles contain said yellow pigment in amounts of 0.5 to 7 parts by weight based on 100 parts by weight of a binder resin containing said non-linear polyester resin.

46. The two-component type developer according to claim 28, wherein said compound represented by the general formula (1) or the acid anhydride thereof comprises a compound represented by the following general formula (4):

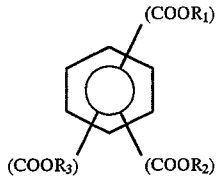

(4)

wherein $R_1$, $R_2$, and $R_3$ are the same or different and are each a hydrogen atom, an alkyl group having 1 to 18 carbon atoms, an alkenyl group having 2 to 18 carbon atoms, or an aryl group having 6 to 18 carbon atoms.

47. The two-component type developer according to claim 28, wherein said compound represented by the general formula (1) or the acid anhydride thereof comprises a compound represented by the following general formula (5):

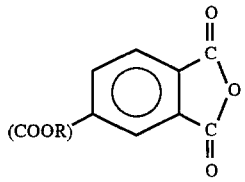

(5)

wherein R is a hydrogen atom, an alkyl group having 1 to 18 carbon atoms, an alkenyl group having 2 to 18 carbon atoms, or an aryl group having 6 to 18 carbon atoms.

48. The two-component type developer according to claim 28, wherein said compound represented by the general formula (1) or the acid anhydride thereof comprises a compound represented by the following general formula (6):

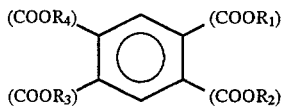

(6)

wherein $R_1$, $R_2$, $R_3$ and $R_4$ are the same or different and are each a hydrogen atom, an alkyl group having 1 to 18 carbon atoms, an alkenyl group having 2 to 18 carbon atoms, or an aryl group having 6 to 18 carbon atoms.

49. The two-component type developer according to claim 28, wherein said compound represented by the general formula (1) or the acid anhydride thereof comprises a compound represented by the following general formula (7):

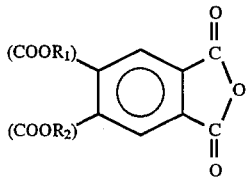

(7)

wherein $R_1$ and $R_2$ are the same or different and are each a hydrogen atom, an alkyl group having 1 to 18 carbon atoms, an alkenyl group having 2 to 18 carbon atoms, or an aryl group having 6 to 18 carbon atoms.

50. The two-component type developer according to claim 28, wherein said compound represented by the general formula (1) or the acid anhydride thereof comprises a compound represented by the following general formula (8):

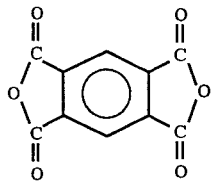

(8)

51. The two-component type developer according to claim 28, wherein said color toner particles contain a charge controlling agent.

52. The two-component type developer according to claim 28, wherein said color toner comprises a mixture of said color toner particles and an additive.

53. The two-component type developer according to claim 52, wherein said additive includes a flowability improver.

54. The two-component type developer according to claim 53, wherein said flowability improver comprises at least one material selected from a group consisting of a fluorocarbon resin powder, a metal salt of fatty acid, a metal oxide, a hydrophobically-treated metal oxide powder, a silica fine powder, and a surface-treated silica fine powder.

55. The two-component type developer according to claim 28, wherein the surface of said carrier is coated with a resin.

56. The two-component type developer according to claim 28, wherein said color toner is present in amounts from 1 to 15 weight of said two-component type developer.

57. An image forming apparatus comprising:

a latent image holding member for holding an electrostatic latent image, and a developing device for developing the electrostatic latent image on said latent image holding member, said developing device comprising:

(i) a developer container containing a non-magnetic one-component developer;

(ii) a developer holding member for holding said non-magnetic one-component developer; and (iii) a developer coating member for coating said non-magnetic one-component developer on said developer holding member so as to form a thin layer of said non-magnetic one-component developer on said developer holding member;

wherein said non-magnetic one-component developer comprises a color toner comprising color toner particles comprising a coloring agent and a non-linear polyester resin, said non-linear polyester resin synthesized from at least a tri- or higher carboxylic acid compound represented by the following general formula (1) or an acid anhydride thereof:

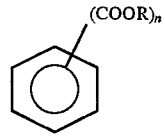

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, said coloring agent is formed from pigment particles, said pigment particles in said color toner particles have a number average diameter of no greater than 0.7 μm and contain at least 60 percent by number of said pigment particles having a diameter of 0.1 to 0.5 μm and no greater than 10 percent by number of the pigment particles having a diameter of at least 0.8 μm, and said color toner has a softening temperature of 85° C. to 120° C. calculated from a flow tester curve.

58. The image forming apparatus according to claim 57, wherein said non-linear polyester resin is formed by reacting (i) a linear polyester resin comprising condensed repeating units of a diol component and a dicarboxylic acid component and (ii) said tri- or higher carboxylic acid compound represented by the general formula (1) or the acid anhydride thereof.

59. The image forming apparatus according to claim 57, wherein said latent image holding member comprises an electrophotographic photosensitive member.

60. The image forming apparatus according to claim 57, wherein said developer applying member elastically urges said non-magnetic one component developer toward said developer holding member.

61. The image forming apparatus according to claim 57, wherein said developer applying member comprises an elastic blade comprising at least one member selected from the group consisting of a silicone rubber, a urethan rubber, and a styrene-butadiene rubber.

62. The image forming apparatus according to claim 57, wherein the thin layer of said one-component developer coated on said developer holding member is thicker than the opposed spatial distance between said latent image holding member and said developer holding member.

63. An image forming method comprising:

forming a color toner image on a recording material using at least one color toner selected from the group consisting of a cyan toner, a magenta toner and a yellow toner, and obtaining a color image by fixing with heat said color toner image formed on said recording material:

wherein said cyan toner comprises cyan toner particles comprising a coloring agent and a non-linear polyester resin, said non-linear polyester resin synthesized from at least a tri- or higher carboxylic acid compound represented by the following general formula (1) or an acid anhydride thereof:

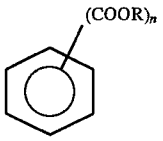

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, said coloring agent is formed from cyan pigment particles, said cyan pigment particles in said cyan toner particles have a number average diameter of no greater than 0.7 μm and contain at least 60 percent by number of said cyan pigment particles having a diameter of 0.1 to 0.5 μm and no greater than 10 percent by number of the cyan pigment particles having a diameter of at least 0.8 μm, and said cyan toner has a softening temperature of 85° C. to 120° C. calculated from a flow tester curve;

said magenta toner comprises magenta toner particles comprising a coloring agent and a non-linear polyester resin, said non-linear polyester resin synthesized from at least a tri- or higher carboxylic acid compound represented by the following general formula (1) or an acid anhydride thereof:

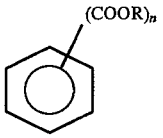

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, said coloring agent is formed from magenta pigment particles, said magenta pigment particles in said magenta toner particles have a number average diameter of no greater than 0.7 μm and contain at least 60 percent by number of said magenta pigment particles having a diameter of 0.1 to 0.5 μm and no greater than 10 percent by number of the magenta pigment particles having a diameter of at least 0.8 μm, and said magenta toner has a softening temperature of 85° C. to 120° C. calculated from a flow tester curve;

said yellow toner comprises yellow toner particles comprising a coloring agent and a non-linear polyester resin, said non-linear polyester resin synthesized from at least a tri- or higher carboxylic acid compound represented by the following general formula (1) or an acid anhydride thereof:

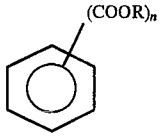

(1)

wherein n is an integer of at least 3, R is a hydrogen atom, an alkyl group having 1 to 18 carbon atoms, an alkenyl group having 2 to 18 carbon atoms, or an aryl group having 6 to 18 carbon atoms, said coloring agent is formed from yellow pigment particles, said yellow pigment particles in said yellow toner particles have a number average diameter of no greater than 0.7 μm and contain at least 60 percent by number of said yellow pigment particles having a diameter of 0.1 to 0.5 μm and no greater than 10 percent by number of the yellow pigment particles having a diameter of at least 0.8 μm, and said yellow toner has a softening temperature of 85° C. to 120° C. calculated from a flow tester curve.

64. A color image forming method according to claim 63, wherein said each non-linear polyester resin is formed by reacting (i) a linear polyester resin comprising condensed repeating unit of a diol component and a dicarboxylic acid component and (ii) said tri- or higher carboxylic acid compound represented by the general formula (1) or the acid anhydride thereof.

65. The color image forming method according to claim 63, wherein said color image is a full-color image formed by combining said cyan toner, said magenta toner, and said yellow toner.

66. The color image forming method according to claim 63, wherein said color image is a full-color image formed by combining said cyan toner, said magenta toner, said yellow toner, and a black toner.

* * * * *

UNITED STATES PATENT AND TRADEMARK OFFICE

CERTIFICATE OF CORRECTION

PATENT NO. : 5,652,075

DATED : July 29, 1997

INVENTOR(S) : MAKOTO KANBAYASHI, ET AL.

It is certified that error appears in the above-identified patent and that said Letters Patent is hereby corrected as shown below:

TITLE PAGE:

AT [56] REFERENCES CITED

UNITED STATES PATENT DOCUMENTS

"Buens et al. ." should read --Burns et al. .--.

AT [57] ABSTRACT

Line 4, "thereof;" should read --thereof:--.

COLUMN 2

Line 34, "effects;" should read --effects:--.

COLUMN 3

Line 35, "deduced" should read --reduced--.

COLUMN 4

Line 44, "points;" should read --points:--; and
Line 66, "further" should read --a further--.

COLUMN 5

Line 26, "further" should read --a further--; and
Line 39, "further" should read --a further--.

COLUMN 6

Line 42, "further" should read --a further--.

UNITED STATES PATENT AND TRADEMARK OFFICE

CERTIFICATE OF CORRECTION

PATENT NO. : 5,652,075

DATED : July 29, 1997

INVENTOR(S) : MAKOTO KANBAYASHI, ET AL.

It is certified that error appears in the above-identified patent and that said Letters Patent is hereby corrected as shown below:

COLUMN 7

Line 9, "aryt" should read --aryl--; and
Line 26, "said cyan" should read --said cyan toner--.

COLUMN 8

Line 32, "further" should read --a further--.

COLUMN 9

Line 23, "inventors" (second occurrence) should read --invention--.

COLUMN 11

Line 26, "objects;" should read --objects,--;
Line 47, "through out" should read --throughout--; and
Line 59, "mean" should read --means--.

COLUMN 13

Line 23, "three" should read --three- --.

COLUMN 14

Line 16, "Hanza" should read --Hansa--; and
Line 23, "perillene" should read --perylene--.

COLUMN 15

Line 2, "through" should read --thorough--; and
Line 36, "atoms,and" should read --atoms, and--.

UNITED STATES PATENT AND TRADEMARK OFFICE

CERTIFICATE OF CORRECTION

PATENT NO. : 5,652,075

DATED : July 29, 1997

INVENTOR(S) : MAKOTO KANBAYASHI, ET AL.

It is certified that error appears in the above-identified patent and that said Letters Patent is hereby corrected as shown below:

COLUMN 17

Line 28, "flowability the" should read --flowability of the--; and
Line 56, "Example" should read --Examples--.

COLUMN 18

Line 15, "preferred" should read --the preferred--.

COLUMN 19

Line 8, "resulting" should read --resulting in--.

COLUMN 20

Line 37, "A" should read --An--; and
Line 54, "an" should read --a--.

COLUMN 25

Line 25, "material" should read --materials--.

COLUMN 26

Line 20, "rubber" should read --rubber layer--;
Line 43, "reading" should read --the reading--;
Line 56, "potential)," should read --potential,--; and
Line 59, "over-head" should read --overhead--.

UNITED STATES PATENT AND TRADEMARK OFFICE

CERTIFICATE OF CORRECTION

PATENT NO. : 5,652,075

DATED : July 29, 1997

INVENTOR(S) : MAKOTO KANBAYASHI, ET AL.

It is certified that error appears in the above-identified patent and that said Letters Patent is hereby corrected as shown below:

COLUMN 27

Line 2, "equation;" should read --equation:--;
Line 4, "$\{(L_1*-L_2*)$" should read --$\{(L_1*-L_2*)^2$--;
Line 8, "original" should read --copied--;
Line 44, "complex" should read --complex:--; and
Line 62, "complex" should read --complex:--.

COLUMN 28

Line 34, "was" should read --were--;
Line 46, "Hencschel" should read --Henschel--; and
Line 61, "toner (c)" should read --toner (C)--.

COLUMN 29

Line 36, "controller)" should read --controller):--; and
Line 38, "Hencschel" should read --Henschel--.

COLUMN 30

Line 7, "times" should read --time--; and
Line 21, "times" (first occurrence) should read --time--.

COLUMN 32

Line 33, "non magnetic" should read --non-magnetic--.

COLUMN 35

Line 29, "than parts" should read --than 15 parts--; and
Line 65, "alkenyt" should read --alkenyl--.

UNITED STATES PATENT AND TRADEMARK OFFICE

CERTIFICATE OF CORRECTION

PATENT NO. : 5,652,075

DATED : July 29, 1997

INVENTOR(S) : MAKOTO KANBAYASHI, ET AL.

It is certified that error appears in the above-identified patent and that said Letters Patent is hereby corrected as shown below:

COLUMN 37

Line 51, "comprises" should read --comprise--;
Line 63, "comprises" should read --comprise--; and
Line 66, "comprises" should read --comprise--.

COLUMN 39

Line 58, "15 weight" should read --15 weight %--.

COLUMN 40

Line 46, "one component" should read --one-component--; and
Line 64, "material:" should read --material;--.

COLUMN 42

Line 37, "unit" should read --units--.

Signed and Sealed this

Twelfth Day of May, 1998

*Attest:*

*Attesting Officer*

BRUCE LEHMAN

*Commissioner of Patents and Trademarks*